US007383180B2

(12) United States Patent
Thumpudi et al.

(10) Patent No.: US 7,383,180 B2
(45) Date of Patent: Jun. 3, 2008

(54) CONSTANT BITRATE MEDIA ENCODING TECHNIQUES

(75) Inventors: Naveen Thumpudi, Sammamish, WA (US); Wei-Ge Chen, Issaquah, WA (US)

(73) Assignee: Microsoft Corporation, Redmond, WA (US)

( * ) Notice: Subject to any disclaimer, the term of this patent is extended or adjusted under 35 U.S.C. 154(b) by 907 days.

(21) Appl. No.: 10/622,822

(22) Filed: Jul. 18, 2003

(65) Prior Publication Data

US 2005/0015259 A1 Jan. 20, 2005

(51) Int. Cl.
*G10L 19/00* (2006.01)

(52) U.S. Cl. ..... 704/229

(58) Field of Classification Search ..... 704/229
See application file for complete search history.

(56) References Cited

U.S. PATENT DOCUMENTS 4,051,470 A 9/1977 Esteban et al.
4,454,546 A 6/1984 Esteban et al.
4,493,091 A 1/1985 Gundry
4,706,260 A 11/1987 Fedele et al.
4,802,224 A 1/1989 Shiraki et al.
4,954,892 A 9/1990 Asai et al.
5,043,919 A 8/1991 Callaway et al.
5,089,889 A 2/1992 Sugiyama
5,136,377 A 8/1992 Johnston et al.
5,235,618 A 8/1993 Sakai et al.
5,266,941 A 11/1993 Akeley et al.
5,317,672 A 5/1994 Crossman et al.
5,394,170 A 2/1995 Akeley et al.
5,398,069 A 3/1995 Huang et al.
5,400,371 A 3/1995 Natarajan
5,414,796 A 5/1995 Jacobs et al.
5,448,297 A 9/1995 Alattar et al.
5,457,495 A 10/1995 Hartung
5,467,134 A 11/1995 Laney et al.
5,533,052 A 7/1996 Bhaskar
5,570,363 A 10/1996 Holm
5,579,430 A 11/1996 Grill et al.
5,586,200 A 12/1996 Devaney et al.
5,602,959 A 2/1997 Bergstrom et al.
5,623,424 A 4/1997 Azadegan et al.

(Continued)

OTHER PUBLICATIONS

Advanced Television Systems Committee, "ATSC Standard: Digital Audio Compression (AC-3), Revision A," pp. 1-140 (Aug. 2001).

(Continued)

*Primary Examiner*—Susan McFadden
(74) *Attorney, Agent, or Firm*—Klarquist Sparkman, LLP

(57) ABSTRACT

CBR control strategies provide constant or relatively constant bitrate output with variable quality. The control strategies include various techniques and tools, which can be used in combination or independently. For example, an audio encoder uses a trellis in two-pass or delayed-decision CBR encoding. The trellis nodes are states derived by quantizing buffer fullness values. The transitions between nodes of a previous stage and nodes of a current stage depend on encoding a current chunk of audio at different quality levels. When pruning the trellis, the encoder uses a cost function that considers smoothness in quality as well as quality in absolute terms. The encoder may store compressed data at different quality levels, then output the compressed data after simplification of the trellis to a suitable point. If the two-pass or delayed-decision CBR encoding fails, the encoder uses one-pass CBR encoding for the sequence or part of the sequence.

48 Claims, 11 Drawing Sheets

U.S. PATENT DOCUMENTS 5,650,860 A 7/1997 Uz
5,654,760 A 8/1997 Ohtsuki
5,661,755 A 8/1997 Van De Kerkhof et al.
5,666,161 A 9/1997 Kohiyama et al.
5,686,964 A 11/1997 Tabatabai et al.
5,724,453 A 3/1998 Ratnakar et al.
5,742,735 A 4/1998 Eberlein et al.
5,754,974 A 5/1998 Griffin et al.
5,787,203 A 7/1998 Lee et al.
5,802,213 A 9/1998 Gardos
5,819,215 A 10/1998 Dobson et al.
5,825,310 A 10/1998 Tsutsui
5,835,149 A 11/1998 Astle
5,845,243 A 12/1998 Smart et al.
5,867,230 A 2/1999 Wang et al.
5,884,039 A 3/1999 Ludwig et al.
5,886,276 A 3/1999 Levine et al.
5,926,226 A 7/1999 Proctor et al.
5,933,451 A 8/1999 Ozkan et al.
5,952,943 A 9/1999 Walsh et al.
5,982,305 A 11/1999 Taylor
5,986,712 A 11/1999 Peterson et al.
5,990,945 A 11/1999 Sinha et al.
5,995,151 A 11/1999 Naveen et al.
6,002,439 A 12/1999 Naveen et al.
6,029,126 A 2/2000 Malvar
6,049,630 A 4/2000 Wang et al.
6,058,362 A 5/2000 Malvar
6,072,831 A 6/2000 Chen
6,073,153 A 6/2000 Malvar
6,075,768 A 6/2000 Mishra
6,081,554 A * 6/2000 Lee et al. ..... 375/240
6,088,392 A 7/2000 Rosenberg
6,111,914 A 8/2000 Bist
6,115,689 A 9/2000 Malvar
6,160,846 A 12/2000 Chiang et al.
6,182,034 B1 1/2001 Malvar
6,212,232 B1 4/2001 Reed et al.
6,215,820 B1 4/2001 Bagni et al.
6,223,162 B1 4/2001 Chen et al.
6,226,407 B1 5/2001 Zabih et al.
6,240,380 B1 5/2001 Malvar
6,243,497 B1 6/2001 Chiang et al.
6,278,735 B1 8/2001 Mohsenian
6,320,825 B1 11/2001 Bruekers et al.
6,351,226 B1 2/2002 Saunders et al.
6,370,502 B1 4/2002 Wu et al.
6,421,738 B1 7/2002 Ratan et al.
6,421,739 B1 7/2002 Holiday
6,441,754 B1 8/2002 Wang et al.
6,473,409 B1 10/2002 Malvar
6,490,554 B2 12/2002 Endo et al.
6,501,798 B1 12/2002 Sivan
6,522,693 B1 2/2003 Lu et al.
6,539,124 B2 3/2003 Sethuraman et al.
6,573,915 B1 6/2003 Sivan et al.
6,574,593 B1 6/2003 Gao et al.
6,654,417 B1 11/2003 Hui
6,654,419 B1 11/2003 Sriram et al.
6,728,317 B1 4/2004 Demos
6,732,071 B2 5/2004 Lopez-Estrada et al.
6,760,598 B1 7/2004 Kurjenniemi
6,810,083 B2 10/2004 Chen et al.
6,876,703 B2 4/2005 Ismaeil et al.
6,895,050 B2 5/2005 Lee
6,934,677 B2 * 8/2005 Chen et al. ..... 704/200.1
6,937,770 B1 * 8/2005 Oguz et al. ..... 382/235
7,027,982 B2 * 4/2006 Chen et al. ..... 704/230
7,143,030 B2 * 11/2006 Chen et al. ..... 704/219
7,146,313 B2 * 12/2006 Chen et al. ..... 704/230
7,260,525 B2 * 8/2007 Chen et al. ..... 704/223
7,263,482 B2 * 8/2007 Chen et al. ..... 704/222
2002/0143556 A1 10/2002 Kadatch
2002/0154693 A1 10/2002 Demos
2002/0176624 A1 11/2002 Kostrzewski et al.
2003/0110236 A1 6/2003 Yang et al.
2003/0115041 A1 6/2003 Chen
2003/0115042 A1 6/2003 Chen et al.
2003/0115050 A1 6/2003 Chen et al.
2003/0115051 A1 6/2003 Chen
2003/0115052 A1 6/2003 Chen
2003/0125932 A1 7/2003 Wang et al.
2005/0015528 A1 1/2005 Du
2005/0084166 A1 4/2005 Boneh et al.
2005/0135484 A1 6/2005 Lee
2005/0157784 A1 7/2005 Tanizawa et al.
2006/0062302 A1 3/2006 Yin et al.

OTHER PUBLICATIONS

Caetano et al., "Rate Control Strategy for Embedded Wavelet Video Coders," *Electronics Letters*, pp. 1815-1817 (Oct. 14, 1999).
Cheung et al., "A Comparison of Scalar Quantization Strategies for Noisy Data Channel Data Transmission," *IEEE Transactions on Communications*, vol. 43, No. 2/3/4, pp. 738-742 (Apr. 1995).
Crisafulli et al., "Adaptive Quantization: Solution via Nonadaptive Linear Control," *IEEE Transactions on Communications*, vol. 41, pp. 741-748 (May 1993).
Dalgic et al., "Characterization of Quality and Traffic for Various Video Encoding Schemes and Various Encoder Control Schemes," Technical Report No. CSL-TR-96-701 (Aug. 1996).
Dolby Laboratories, "AAC Technology," 4 pp. [Downloaded from the web site aac-audio.com on World Wide Web on Nov. 21, 2001.]
Fraunhofer-Gesellschaft, "MPEG Audio Layer-3," 4 pp. [Downloaded from the World Wide Web on Oct. 24, 2001.]
Fraunhofer-Gesellschaft, "MPEG-2 AAC," 3 pp. [Downloaded from the World Wide Web on Oct. 24, 2001.]
Gibson et al., "Quantization," Digital Compression for Multimedia, Chapter 4, pp. 113-138 (1998).
Gibson et al., "Chapter 7: Frequency Domain Coding," Digital Compression for Multimedia, Title Page, Contents, Morgan Kaufman Publishers, Inc., pp. iii, v-xi, and 227-262 (1998).
Gibson et al., "Frequency Domain Speech and Audio Coding Standards," Digital Compression for Multimedia, Chapter 8, pp. 263-290 (1998).
Gibson et al., "MPEG Audio," Digital Compression for Multimedia, Chapter 11.4, pp. 398-402 (1998).
ISO, "MPEG-4 Video Verification Model version 18.0," ISO/IEC JTC1/SC29/WG11 N3908, Jan. 2001, Pisa, pp. 1-10, 299-311 (Jan. 2001).
ISO/IEC 11172-3, Information Technology—Coding of Moving Pictures and Associated Audio for Digital Storage Media at Up to About 1.5 Mbit/s—Part 3: Audio, 154 pp. (1993).
ISO/IEC 13818-7, "Information Technology—Generic Coding of Moving Pictures and Associated Audio Information, Part 7: Advanced Audio Coding (AAC)," pp. i-iv, 1-145, ISO/IEC (1997).
ISO/IEC 13818-7, Technical Corrigendum 1, "Information Technology—Generic Coding of Moving Pictures and Associated Audio Information, Part 7: Advanced Audio Coding (AAC), Technical Corrigendum," pp. 1-22, ISO/IEC (1997).
ITU, Recommendation ITU-R BS 1115, Low Bit-Rate Audio Coding, 9 pp. (1994).
Jafarkhani et al., "Entropy-Constrained Successively Refinable Scalar Quantization," *Proc. DCC '97*, pp. 337-346 (1997).
Jayant et al., *Digital Coding of Waveforms, Principles and Applications to Speech and Video*, pp. 428-445, Prentice Hall (1984).
Naveen et al., "Subband Finite State Scalar Quantization," IEEE Transactions on Image Processing, vol. 5, No. 1, pp. 150-155 (Jan. 1996).
Ortega et al., "Adaptive Scalar Optimization Without Side Information," IEEE Transactions on Image Processing, vol. 6, No. 5, pp. 665-676 (May 1997).
Ortega et al., "Optimal Buffer-constrained Source Quantization and Fast Approximation," IEEE, pp. 192-195 (1992).

Ramchandran et al., "Bit Allocation for Dependent Quantization with Applications to MPEG Video Coders," IEEE, pp. v-381-v-384 (1993).
Ratnakar et al., "RD-OPT: An Efficient Algorithm for Optimizing DCT Quantization Tables," 11 pp.
Ribas Corbera et al., "Rate Control in DCT Video Coding for Low-Delay Communications," *IEEE Transactions on Circuits and Systems for Video Technology*, vol. 9, No. 1, pp. 172-185 (Feb. 1999).
Sidiropoulos, "Optimal Adaptive Scalar Quantization and Image Compression," *ICIP '98*, pp. 574-578 (1998).
Solari, "Chapter 8: Sound and Audio," Digital Video and Audio Compression, Title Page, Contents, McGraw-Hill, Inc., pp. iii, v-vi, and 187-211 (1997).
Srinivasan et al., "High-Quality Audio Compression Using an Adaptive Wavelet Packet Decomposition and Psychoacoustic Modeling," IEEE Transactions on Signal Processing, vol. 46, No. 4, pp. 1085-1093 (Apr. 1998).
Sullivan, "Optimal Entropy Constrained Scalar Quantization for Exponential and Laplacian Random Variables," *ICASSP '94*, pp. v-265-v268 (1994).
Trushkin, "On the Design on an Optimal Quantizer," *IEEE Transactions on Information Theory*, vol. 39, No. 4, pp. 1180-1194 (Jul. 1993).
Westerink et al., "Two-pass MPEG-2 Variable-bit-rate Encoding," *IBM J. Res. Develop.*, vol. 43, No. 4, pp. 471-488 (1999).
Wong, "Progressively Adaptive Scalar Quantization," *ICIP '96*, pp. 357-360 (1996).
Wu et al., "Entropy-Constrained Scalar Quantization and Minimum Entropy with Error Bound by Discrete Wavelet Transforms in Image Compression," *IEEE Transactions on Signal Processing*, vol. 48, No. 4, pp. 1133-1143 (Apr. 2000).
Wu et al., "Quantizer Monotonicities and Globally Optimally Scalar Quantizer Design," *IEEE Transactions on Information Theory*, vol. 39, No. 3, pp. 1049-1053 (May 1993).
Baron et al, "Coding the Audio Signal," *Digital Image and Audio Communications*, pp. 101-128 (1998).
Beerends, "Audio Quality Determination Based on Perceptual Measurement Techniques," *Applications of Digital Signal Processing to Audio and Acoustics*, Chapter 1, Ed. Mark Kahrs, Karlheinz Brandenburg, Kluwer Acad. Publ., pp. 1-38 (1998).
De Luca, "AN1090 Application Note: STA013 MPEG 2.5 Layer III Source Decoder," *STMicroelectronics*, 17 pp. (1999).
de Queiroz et al., "Time-Varying Lapped Transforms and Wavelet Packets," *IEEE Transactions on Signal Processing*, vol. 41, pp. 3293-3305 (1993).
"DivX Multi Standard Video Encoder," 2 pp. (Downloaded from the World Wide Web on Jan. 24, 2006).
Gibson et al., *Digital Compression for Multimedia*, Chapter 11.6. 2-11.6.4, "More MPEG," Morgan Kaufman Publishers, Inc., pp. 415-416 (1998).
Gill et al., "Creating High-Quality Content with Microsoft Windows Media Encoder 7," 4 pp. (2000). [Downloaded from the World Wide Web on May 1, 2002.]
Herley et al., "Tilings of the Time-Frequency Plane: Construction of Arbitrary Orthogonal Bases and Fast Tiling Algorithms," *IEEE Transactions on Signal Processing*, vol. 41, No. 12, pp. 3341-3359 (1993).
ISO/IEC, "Information Technology—Coding of Audio-Visual Objects: Visual, ISO/IEC 14496-2, Committee Draft," 330 pp. (1998).
ISO/IEC, "ISO/IEC 11172-2: Information Technology—Coding of Moving Pictures and Associatged Audio for Storage Medua at up to About 1.5 Mbit/s," 122 pp. (1993).
ITU-T, "ITU-T Recommendation H.261: Video Codec for Audio-visual Services at $p$ x 64 kbits," 28 pp. (1993).
ITU-T, "ITU-T Recommendation H.262: Information Technology—Generic Coding of Moving Pictures and Associated Audio Information: Video," 218 pp. (1995).
ITU-T, "ITU-T Recommendation H.263: Video Coding for Low Bit Rate Communication," 167 pp. (1998).
ITU, Recommendation ITU-R BS 1387, Method for Objective Measurements of Perceived Audio Quality, 89 pp. (1998).
Joint Video Team of ISO/IEC MPEG and ITU-T VCEG, "Committee Draft of Joint Video Specification (ITU-T Recommendation H.264, ISO/IEC 14496-10 AVC," 142 pp. (Aug. 2002).
Kondoz, *Digital Speech: Coding for Low Bit Rate Communications Systems*, "Chapter 3.3: Linear Predictive Modeling of Speech Signals," and "Chapter 4: LPC Parameter Quantisation Using LSFs," John Wiley & Sons, pp. 42-53 and 79-97 (1994).
Mook, "Next-Gen Windows Media Player Leaks to the Web," *BetaNews*, 17 pp. (Jul. 19, 2002) [Downloaded from the World Wide Web on Aug. 8, 2003].
OPTICOM GmbH, "Objective Perceptual Measurement," 14 pp. [Downloaded from the World Wide Web on Oct. 24, 2001].
Phamdo, "Speech Compression," 13 pp. [Downloaded from the World Wide Web on Nov. 25, 2001].
Schuster et al., "A Theory for the Optimal Bit Allocation Between Displacement Vector Field and Displaced Frame Difference," *IEEE J. on Selected Areas in Comm.*, vol. 15, No. 9, pp. 1739-1751 (Dec. 1997).
Sullivan et al., "Rate-Distortion Optimization for Video Compression,"*IEEE Signal Processing Magazine*, pp. 74-90 (Nov. 1998).
Sullivan et al., "The H.264/AVC Advanced Video Coding Standard: Overview and Introduction to the Fidelity Range Extensions," 21 pp. (Aug. 2004).
Tao et al., "Adaptive Model-driven Bit Allocation for MPEG Video Coding," *IEEE Transactions on Circuits and Systems for Video Tech.*, vol. 10, No. 1, pp. 147-157 (Feb. 2000).
Tsang et al., "Fuzzy based rate control for real-time MPEG video," 12 pp.
Yang et al., "Rate Control for Videophone Using Local Perceptual Cues," *IEEE Transactions on Circuits and Systems for Video Tech.*, vol. 15, No. 4, pp. 496-507 (Apr. 2005).
Li et al., "Optimal Linear Interpolation Coding for Server-Based Computing," *Proc. IEEE Int'l Conf. on Communications*, 5 pp. (2002).
Cliff Reader, "History of MPEG Video Compression—Ver. 4.0," 99 pp., document marked Dec. 16, 2003.
Ronda et al., "Rate Control and Bit Allocation for MPEG-4," *IEEE Transactions on Circuits and Systems for Video Technology*, pp. 1243-1258 (1999).
Schaar-Mitrea et al., "Hybrid Compression of Video with Graphics in DTV Communication Systems," *IEEE Trans. on Consumer Electronics*, pp. 1007-1017 (2000).
Vetro et al., "An Overview of MPEG-4 Object-Based Encoding Algorithms," *IEEE International Symposium on Information Technology*, pp. 366-369 (2001).
Printouts of FTP directories from http://ftp3.itu.ch , 8 pp. (downloaded from the World Wide Web on Sep. 20, 2005.).
Hsu et al., "Joint Selection of Source and Channel Rate for VBR Video Transmission Under ATM Policing Constraints," *IEEE Journal on Slected Areas in Communications*, vol. 15, No. 6, pp. 1016-1028 (Aug. 1997).
Pao, "Encoding Stored Video for Streaming Application," *IEEE Transaction on Circuits and Systems for Video Technology*, vol. 11, No. 2, pp. 199-209 (Feb. 2001).
Reed et al., "Constrained Bit-Rate Control for Very Low Bit-Rate Streaming-Video Applications," *IEEE Transactions on Circuits and Systems for Video Technology*, vol. 11, No. 7, pp. 882-889 (Jul. 2001).
Reibman et al., "Constraints on Variable Bit-rate Video for ATM Networks," *IEEE Transactions on Circuits and Systems for Video Technology*, No. 4, pp. 361-372 (1992).
Sheu et al., "A Buffer Allocation Mechanism for VBR Bideo Playback," *Communication Tech. Proc.* 2000, WCC-ICCT 2000, vol. 2, pp. 1641-1644 (2000).
Walpole et al., "A Player for Adaptive MPEG Video Streaming over the Internet," *Proc. SPIE*, vol. 3240, pp. 270-281 (1998).
Ortega et al., "Optimal Trellis-based Buffered Compression and Fast Approximations," IEEE Transactions on Image Processing, vol. 3, No. 1, pp. 26-40 (Jan. 1994).

* cited by examiner

Figure 1,
Prior Art

Figure 2,
Prior Art

CONSTANT BITRATE MEDIA ENCODING TECHNIQUES

TECHNICAL FIELD

The present invention relates to control strategies for media. For example, an audio encoder uses a two-pass or delayed-decision constant bitrate control strategy when encoding audio data to produce constant or relatively constant bitrate output of variable quality.

BACKGROUND

With the introduction of compact disks, digital wireless telephone networks, and audio delivery over the Internet, digital audio has become commonplace. Engineers use a variety of techniques to control the quality and bitrate of digital audio. To understand these techniques, it helps to understand how audio information is represented in a computer and how humans perceive audio.

I. Representation of Audio Information in a Computer

A computer processes audio information as a series of numbers representing the audio information. For example, a single number can represent an audio sample, which is an amplitude (i.e., loudness) at a particular time. Several factors affect the quality of the audio information, including sample depth, sampling rate, and channel mode.

Sample depth (or precision) indicates the range of numbers used to represent a sample. The more values possible for the sample, the higher the quality because the number can capture more subtle variations in amplitude. For example, an 8-bit sample has 256 possible values, while a 16-bit sample has 65,536 possible values.

The sampling rate (usually measured as the number of samples per second) also affects quality. The higher the sampling rate, the higher the quality because more frequencies of sound can be represented. Some common sampling rates are 8,000, 11,025, 22,050, 32,000, 44,100, 48,000, and 96,000 samples/second.

Mono and stereo are two common channel modes for audio. In mono mode, audio information is present in one channel. In stereo mode, audio information is present in two channels, usually labeled the left and right channels. Other modes with more channels, such as 5-channel surround sound, are also possible. Table 1 shows several formats of audio with different quality levels, along with corresponding raw bitrate costs.

TABLE 1

Bitrates for different quality audio information

| Quality | Sample Depth (bits/sample) | Sampling Rate (samples/second) | Mode | Raw Bitrate (bits/second) |
|---|---|---|---|---|
| Internet telephony | 8 | 8,000 | mono | 64,000 |
| telephone | 8 | 11,025 | mono | 88,200 |
| CD audio | 16 | 44,100 | stereo | 1,411,200 |
| high quality audio | 16 | 48,000 | stereo | 1,536,000 |

As Table 1 shows, the cost of high quality audio information such as CD audio is high bitrate. High quality audio information consumes large amounts of computer storage and transmission capacity.

II. Processing Audio Information in a Computer

Many computers and computer networks lack the resources to process raw digital audio. Compression (also called encoding or coding) decreases the cost of storing and transmitting audio information by converting the information into a lower bitrate form. Compression can be lossless (in which quality does not suffer) or lossy (in which quality suffers but bitrate reduction from subsequent lossless compression is more dramatic). Decompression (also called decoding) extracts a reconstructed version of the original information from the compressed form.

A. Standard Perceptual Audio Encoders and Decoders

Generally, the goal of audio compression is to digitally represent audio signals to provide maximum signal quality with the least possible amount of bits. A conventional audio coder/decoder ["codec"] system uses subband/transform coding, quantization, rate control, and variable length coding to achieve its compression. The quantization and other lossy compression techniques introduce potentially audible noise into an audio signal. The audibility of the noise depends on how much noise there is and how much of the noise the listener perceives. The first factor relates mainly to objective quality, while the second factor depends on human perception of sound.

An audio encoder can use various techniques to provide the best possible quality for a given bitrate, including transform coding, modeling human perception of audio, and rate control. As a result of these techniques, an audio signal can be more heavily quantized at selected frequencies or times to decrease bitrate, yet the increased quantization will not significantly degrade perceived quality for a listener.

FIG. 1 shows a generalized diagram of a transform-based, perceptual audio encoder (100) according to the prior art. FIG. 2 shows a generalized diagram of a corresponding audio decoder (200) according to the prior art. Though the codec system shown in FIGS. 1 and 2 is generalized, it has characteristics found in several real world codec systems, including versions of Microsoft Corporation's Windows Media Audio ["WMA"] encoder and decoder, in particular WMA version 8 ["WMA8"]. Other codec systems are provided or specified by the Motion Picture Experts Group, Audio Layer 3 ["MP3"] standard, the Motion Picture Experts Group 2, Advanced Audio Coding ["AAC"] standard, and Dolby AC3. For additional information about these other codec systems, see the respective standards or technical publications.

1. Perceptual Audio Encoder

Overall, the encoder (100) receives a time series of input audio samples (105), compresses the audio samples (105) in one pass, and multiplexes information produced by the various modules of the encoder (100) to output a bitstream (195) at a constant or relatively constant bitrate. The encoder (100) includes a frequency transformer (110), a multichannel transformer (120), a perception modeler (130), a weighter (140), a quantizer (150), an entropy encoder (160), a controller (170), and a bitstream multiplexer ["MUX"] (180).

The frequency transformer (110) receives the audio samples (105) and converts them into data in the frequency domain. For example, the frequency transformer (110) splits the audio samples (105) into blocks, which can have variable size to allow variable temporal resolution. Small blocks allow for greater preservation of time detail at short but active transition segments in the input audio samples (105), but sacrifice some frequency resolution. In contrast, large blocks have better frequency resolution and worse time resolution, and usually allow for greater compression efficiency at longer and less active segments. Blocks can overlap to reduce perceptible discontinuities between blocks that could otherwise be introduced by later quantization. For multi-channel audio, the frequency transformer (110) uses the same pattern of windows for each channel in a particular frame. The frequency transformer (110) outputs blocks of frequency coefficient data to the multi-channel transformer (120) and outputs side information such as block sizes to the MUX (180).

Transform coding techniques convert information into a form that makes it easier to separate perceptually important information from perceptually unimportant information. The less important information can then be quantized heavily, while the more important information is preserved, so as to provide the best perceived quality for a given bitrate.

For multi-channel audio data, the multiple channels of frequency coefficient data produced by the frequency transformer (110) often correlate. To exploit this correlation, the multi-channel transformer (120) can convert the multiple original, independently coded channels into jointly coded channels. For example, if the input is stereo mode, the multi-channel transformer (120) can convert the left and right channels into sum and difference channels:

$$X_{Sum}[k] = \frac{X_{Left}[k] + X_{Right}[k]}{2}, \text{ and} \tag{1}$$

$$X_{Diff}[k] = \frac{X_{Left}[k] - X_{Right}[k]}{2}. \tag{2}$$

Or, the multi-channel transformer (120) can pass the left and right channels through as independently coded channels. The decision to use independently or jointly coded channels is predetermined or made adaptively during encoding. For example, the encoder (100) determines whether to code stereo channels jointly or independently with an open loop selection decision that considers the (a) energy separation between coding channels with and without the multi-channel transform and (b) the disparity in excitation patterns between the left and right input channels. Such a decision can be made on a window-by-window basis or only once per frame to simplify the decision. The multi-channel transformer (120) produces side information to the MUX (180) indicating the channel mode used.

The encoder (100) can apply multi-channel rematrixing to a block of audio data after a multi-channel transform. For low bitrate, multi-channel audio data in jointly coded channels, the encoder (100) selectively suppresses information in certain channels (e.g., the difference channel) to improve the quality of the remaining channel(s) (e.g., the sum channel). For example, the encoder (100) scales the difference channel by a scaling factor ρ:

$$\tilde{X}_{Diff}[k]=\rho\cdot X_{Diff}[k] \tag{3}$$

where the value of ρ is based on: (a) current average levels of a perceptual audio quality measure such as Noise to Excitation Ratio ["NER"], (b) current fullness of a virtual buffer, (c) bitrate and sampling rate settings of the encoder (100), and (d) the channel separation in the left and right input channels.

The perception modeler (130) processes audio data according to a model of the human auditory system to improve the perceived quality of the reconstructed audio signal for a given bitrate. For example, an auditory model typically considers the range of human hearing and critical bands. The human nervous system integrates sub-ranges of frequencies. For this reason, an auditory model may organize and process audio information by critical bands. Different auditory models use a different number of critical bands (e.g., 25, 32, 55, or 109) and/or different cut-off frequencies for the critical bands. Bark bands are a well-known example of critical bands. Aside from range and critical bands, interactions between audio signals can dramatically affect perception. An audio signal that is clearly audible if presented alone can be completely inaudible in the presence of another audio signal, called the masker or the masking signal. The human ear is relatively insensitive to distortion or other loss in fidelity (i.e., noise) in the masked signal, so the masked signal can include more distortion without degrading perceived audio quality. In addition, an auditory model can consider a variety of other factors relating to physical or neural aspects of human perception of sound.

Using an auditory model, an audio encoder can determine which parts of an audio signal can be heavily quantized without introducing audible distortion, and which parts should be quantized lightly or not at all. Thus, the encoder can spread distortion across the signal so as to decrease the audibility of the distortion. The perception modeler (130) outputs information that the weighter (140) uses to shape noise in the audio data to reduce the audibility of the noise. For example, using any of various techniques, the weighter (140) generates weighting factors (sometimes called scaling factors) for quantization matrices (sometimes called masks) based upon the received information. The weighting factors in a quantization matrix include a weight for each of multiple quantization bands in the audio data, where the quantization bands are frequency ranges of frequency coefficients. The number of quantization bands can be the same as or less than the number of critical bands. Thus, the weighting factors indicate proportions at which noise is spread across the quantization bands, with the goal of minimizing the audibility of the noise by putting more noise in bands where it is less audible, and vice versa. The weighting factors can vary in amplitudes and number of quantization bands from block to block. The weighter (140) then applies the weighting factors to the data received from the multi-channel transformer (120).

In one implementation, the weighter (140) generates a set of weighting factors for each window of each channel of multi-channel audio, or shares a single set of weighting factors for parallel windows of jointly coded channels. The weighter (140) outputs weighted blocks of coefficient data to the quantizer (150) and outputs side information such as the sets of weighting factors to the MUX (180).

A set of weighting factors can be compressed for more efficient representation using direct compression. In the direct compression technique, the encoder (100) uniformly quantizes each element of a quantization matrix. The encoder then differentially codes the quantized elements, and Huffman codes the differentially coded elements. In some cases (e.g., when all of the coefficients of particular quantization bands have been quantized or truncated to a value of 0), the decoder (200) does not require weighting factors for all quantization bands. In such cases, the encoder (100) gives values to one or more unneeded weighting factors that are identical to the value of the next needed weighting factor in a series, which makes differential coding of elements of the quantization matrix more efficient.

Or, for low bitrate applications, the encoder (100) can parametrically compress a quantization matrix to represent the quantization matrix as a set of parameters, for example, using Linear Predictive Coding ["LPC"] of pseudo-autocorrelation parameters computed from the quantization matrix.

The quantizer (150) quantizes the output of the weighter (140), producing quantized coefficient data to the entropy encoder (160) and side information including quantization step size to the MUX (180). Quantization maps ranges of input values to single values. In a generalized example, with uniform, scalar quantization by a factor of 3.0, a sample with a value anywhere between −1.5 and 1.499 is mapped to 0, a sample with a value anywhere between 1.5 and 4.499 is mapped to 1, etc. To reconstruct the sample, the quantized value is multiplied by the quantization factor, but the reconstruction is imprecise. Continuing the example started above, the quantized value 1 reconstructs to 1×3=3; it is impossible to determine where the original sample value was in the range 1.5 to 4.499. Quantization causes a loss in fidelity of the reconstructed value compared to the original value, but can dramatically improve the effectiveness of subsequent lossless compression, thereby reducing bitrate. Adjusting quantization allows the encoder (100) to regulate the quality and bitrate of the output bitstream (195) in conjunction with the controller (170). In FIG. 1, the quantizer (150) is an adaptive, uniform, scalar quantizer. The quantizer (150) applies the same quantization step size to each frequency coefficient, but the quantization step size itself can change from one iteration of a quantization loop to the next to affect quality and the bitrate of the entropy encoder (160) output. Other kinds of quantization are non-uniform quantization, vector quantization, and/or non-adaptive quantization.

The entropy encoder (160) losslessly compresses quantized coefficient data received from the quantizer (150). The entropy encoder (160) can compute the number of bits spent encoding audio information and pass this information to the rate/quality controller (170).

The controller (170) works with the quantizer (150) to regulate the bitrate and/or quality of the output of the encoder (100). The controller (170) receives information from other modules of the encoder (100) and processes the received information to determine a desired quantization step size given current conditions. The controller (170) outputs the quantization step size to the quantizer (150) with the goal of satisfying bitrate and quality constraints. U.S. patent application Ser. No. 10/017,694, filed Dec. 14, 2001, entitled "Quality and Rate Control Strategy for Digital Audio," published on Jun. 19, 2003, as Publication No. US-2003-0115050-A1, includes description of quality and rate control as implemented in an audio encoder of WMA8, as well as additional description of other quality and rate control techniques.

The encoder (100) can apply noise substitution and/or band truncation to a block of audio data. At low and mid-bitrates, the audio encoder (100) can use noise substitution to convey information in certain bands. In band truncation, if the measured quality for a block indicates poor quality, the encoder (100) can completely eliminate the coefficients in certain (usually higher frequency) bands to improve the overall quality in the remaining bands.

The MUX (180) multiplexes the side information received from the other modules of the audio encoder (100) along with the entropy encoded data received from the entropy encoder (160). The MUX (180) outputs the information in a format that an audio decoder recognizes. The MUX (180) includes a virtual buffer that stores the bitstream (195) to be output by the encoder (100).

2. Perceptual Audio Decoder

Overall, the decoder (200) receives a bitstream (205) of compressed audio information including entropy encoded data as well as side information, from which the decoder (200) reconstructs audio samples (295). The audio decoder (200) includes a bitstream demultiplexer ["DEMUX"] (210), an entropy decoder (220), an inverse quantizer (230), a noise generator (240), an inverse weighter (250), an inverse multi-channel transformer (260), and an inverse frequency transformer (270).

The DEMUX (210) parses information in the bitstream (205) and sends information to the modules of the decoder (200). The DEMUX (210) includes one or more buffers to compensate for variations in bitrate due to fluctuations in complexity of the audio, network jitter, and/or other factors.

The entropy decoder (220) losslessly decompresses entropy codes received from the DEMUX (210), producing quantized frequency coefficient data. The entropy decoder (220) typically applies the inverse of the entropy encoding technique used in the encoder.

The inverse quantizer (230) receives a quantization step size from the DEMUX (210) and receives quantized frequency coefficient data from the entropy decoder (220). The inverse quantizer (230) applies the quantization step size to the quantized frequency coefficient data to partially reconstruct the frequency coefficient data.

From the DEMUX (210), the noise generator (240) receives information indicating which bands in a block of data are noise substituted as well as any parameters for the form of the noise. The noise generator (240) generates the patterns for the indicated bands, and passes the information to the inverse weighter (250).

The inverse weighter (250) receives the weighting factors from the DEMUX (210), patterns for any noise-substituted bands from the noise generator (240), and the partially reconstructed frequency coefficient data from the inverse quantizer (230). As necessary, the inverse weighter (250) decompresses the weighting factors, for example, entropy decoding, inverse differentially coding, and inverse quantizing the elements of the quantization matrix. The inverse weighter (250) applies the weighting factors to the partially reconstructed frequency coefficient data for bands that have not been noise substituted. The inverse weighter (250) then adds in the noise patterns received from the noise generator (240) for the noise-substituted bands.

The inverse multi-channel transformer (260) receives the reconstructed frequency coefficient data from the inverse weighter (250) and channel mode information from the DEMUX (210). If multi-channel audio is in independently coded channels, the inverse multi-channel transformer (260) passes the channels through. If multi-channel data is in jointly coded channels, the inverse multi-channel transformer (260) converts the data into independently coded channels.

The inverse frequency transformer (270) receives the frequency coefficient data output by the multi-channel transformer (260) as well as side information such as block sizes from the DEMUX (210). The inverse frequency transformer (270) applies the inverse of the frequency transform used in the encoder and outputs blocks of reconstructed audio samples (295).

III. Controlling Rate and Quality

Different audio applications have different quality and bitrate requirements. Certain applications require constant or relatively constant bitrate ["CBR"]. One such CBR application is encoding audio for streaming over the Internet. Other applications require constant or relatively constant quality over time for compressed audio information, resulting in variable bitrate ["VBR"] output.

A. CBR Encoding for Audio Information

The goal of a CBR encoder is to output compressed audio information at a constant bitrate despite changes in the complexity of the audio information. Complex audio information is typically less compressible than simple audio information. To meet bitrate requirements, the CBR encoder can adjust how the audio information is quantized. The quality of the compressed audio information then varies, with lower quality for periods of complex audio information due to increased quantization and higher quality for periods of simple audio information due to decreased quantization.

While adjustment of quantization and audio quality is necessary at times to satisfy CBR requirements, some CBR encoders can cause unnecessary changes in quality, which can result in thrashing between high quality and low quality around the appropriate, middle quality. Moreover, when changes in audio quality are necessary, some CBR encoders often cause abrupt changes, which are more noticeable and objectionable than smooth changes.

WMA version 7.0 ["WMA7"] includes an audio encoder that can be used for CBR encoding of audio information for streaming. The WMA7 encoder uses a virtual buffer and rate control to handle variations in bitrate due to changes in the complexity of audio information. In general, the WMA7 encoder uses one-pass CBR rate control. In a one-pass encoding scheme, an encoder analyzes the input signal and generates a compressed bit stream in the same pass through the input signal.

To handle short-term fluctuations around the constant bitrate (such as those due to brief variations in complexity), the WMA7 encoder uses a virtual buffer that stores some duration of compressed audio information. For example, the virtual buffer stores compressed audio information for 5 seconds of audio playback. The virtual buffer outputs the compressed audio information at the constant bitrate, so long as the virtual buffer does not underflow or overflow. Using the virtual buffer, the encoder can compress audio information at relatively constant quality despite variations in complexity, so long as the virtual buffer is long enough to smooth out the variations. In practice, virtual buffers must be limited in duration in order to limit system delay, however, and buffer underflow or overflow can occur unless the encoder intervenes.

To handle longer-term deviations from the constant bitrate (such as those due to extended periods of complexity or silence), the WMA7 encoder adjusts the quantization step size of a uniform, scalar quantizer in a rate control loop. The relation between quantization step size and bitrate is complex and hard to predict in advance, so the encoder tries one or more different quantization step sizes until the encoder finds one that results in compressed audio information with a bitrate sufficiently close to a target bitrate. The encoder sets the target bitrate to reach a desired buffer fullness, preventing buffer underflow and overflow. Based upon the complexity of the audio information, the encoder can also allocate additional bits for a block or deallocate bits when setting the target bitrate for the rate control loop.

The WMA7 encoder measures the quality of the reconstructed audio information for certain operations (e.g., deciding which bands to truncate). The WMA7 encoder does not use the quality measurement in conjunction with adjustment of the quantization step size in a quantization loop, however.

The WMA7 encoder controls bitrate and provides good quality for a given bitrate, but can cause unnecessary quality changes. Moreover, with the WMA7 encoder, necessary changes in audio quality are not as smooth as they could be in transitions from one level of quality to another.

U.S. patent application Ser. No. 10/017,694 includes description of quality and rate control as implemented in the WMA8 encoder, as well as additional description of other quality and rate control techniques. In general, the WMA8 encoder uses one-pass CBR quality and rate control, with complexity estimation of future frames. For additional detail, see U.S. patent application Ser. No. 10/017,694.

The WMA8 encoder smoothly controls rate and quality, and provides good quality for a given bitrate. As a one-pass encoder, however, the WMA8 encoder relies on partial and incomplete information about future frames in an audio sequence.

Numerous other audio encoders use rate control strategies. For example, see U.S. Pat. No. 5,845,243 to Smart et al. Such rate control strategies potentially consider information other than or in addition to current buffer fullness, for example, the complexity of the audio information.

Several international standards describe audio encoders that incorporate distortion and rate control. The MP3 and AAC standards each describe techniques for controlling distortion and bitrate of compressed audio information.

In MP3, the encoder uses nested quantization loops to control distortion and bitrate for a block of audio information called a granule. Within an outer quantization loop for controlling distortion, the MP3 encoder calls an inner quantization loop for controlling bitrate.

In the outer quantization loop, the MP3 encoder compares distortions for scale factor bands to allowed distortion thresholds for the scale factor bands. A scale factor band is a range of frequency coefficients for which the encoder calculates a weight called a scale factor. Each scale factor starts with a minimum weight for a scale factor band. After an iteration of the inner quantization loop, the encoder amplifies the scale factors until the distortion in each scale factor band is less than the allowed distortion threshold for that scale factor band, with the encoder calling the inner quantization loop for each set of scale factors. In special cases, the encoder exits the outer quantization loop even if distortion exceeds the allowed distortion threshold for a scale factor band (e.g., if all scale factors have been amplified or if a scale factor has reached a maximum amplification).

In the inner quantization loop, the MP3 encoder finds a satisfactory quantization step size for a given set of scale factors. The encoder starts with a quantization step size expected to yield more than the number of available bits for the granule. The encoder then gradually increases the quantization step size until it finds one that yields fewer than the number of available bits.

The MP3 encoder calculates the number of available bits for the granule based upon the average number of bits per granule, the number of bits in a bit reservoir, and an estimate of complexity of the granule called perceptual entropy. The bit reservoir counts unused bits from previous granules. If a granule uses less than the number of available bits, the MP3 encoder adds the unused bits to the bit reservoir. When the bit reservoir gets too full, the MP3 encoder preemptively allocates more bits to granules or adds padding bits to the compressed audio information. The MP3 encoder uses a psychoacoustic model to calculate the perceptual entropy of the granule based upon the energy, distortion thresholds, and widths for frequency ranges called threshold calculation partitions. Based upon the perceptual entropy, the encoder can allocate more than the average number of bits to a granule.

For additional information about MP3 and AAC, see the MP3 standard ("ISO/IEC 11172-3, Information Technology—Coding of Moving Pictures and Associated Audio for Digital Storage Media at Up to About 1.5 Mbit/s—Part 3: Audio") and the AAC standard.

Other audio encoders use a combination of filtering and zero tree coding to jointly control quality and bitrate, in which an audio encoder decomposes an audio signal into bands at different frequencies and temporal resolutions. The encoder formats band information such that information for less perceptually important bands can be incrementally removed from a bitstream, if necessary, while preserving the most information possible for a given bitrate. For more information about zero tree coding, see Srinivasan et al., "High-Quality Audio Compression Using an Adaptive Wavelet Packet Decomposition and Psychoacoustic Modeling," IEEE Transactions on Signal Processing, Vol. 46, No. 4, pp. (April 1998).

Still other audio encoders use a trellis coding with a delayed-decision encoding scheme. See Jayant et al., "Delayed Decision Coding," Chapter 9 in *Digital Coding of Waveforms—Principles and Applications to Speech and Video*, Prentice-Hall (1984), which describes using trellis coding in conjunction with differential pulse code modulation of samples.

In summary, to generate CBR streams, an encoder uses a rate controller that keeps track of expected decoder buffer fullness. The rate controller slowly modulates the quality of encoding based on the buffer fullness and other control parameters such as parameters relating to the complexity of the input that is ahead. If the future input is less complex than the current input, the rate controller allocates more bits for the current input. On the other hand, if the future input is more complex than the current input, the rate controller reserves buffer space by allocating fewer bits for the current input.

One difficulty in rate control is determining the compression complexity of future input. One approach that is often employed, for example, in the WMA8 encoder, is to have a look-ahead buffer in which the encoder estimates the coding complexity of the audio information. This approach has some shortcomings due to (1) the limited size of the look-ahead buffer, and (2) the presence of coding decisions that cannot be resolved until actual coding time.

Another approach is for an encoder to encode all input blocks at all possible quality levels (or, simply all quantization step sizes). Through an exhaustive search of the results of encoding the whole sequence, the encoder then finds the best solution. This is computationally difficult, if not impossible, for sequences of any significant length. If each block is coded at M different quality levels and there are N blocks in a file, then the encoder must analyze $M^N$ possible solutions before selecting the winning trace through the blocks. Suppose a 3-minute song includes 5,000 blocks, with each block being encoded at 10 possible qualities. This results in up to $10^{5,000}$ potential traces, which is too many for the encoder to process in an exhaustive search.

B. Rate Control for Other Media

Outside of the field of audio encoding, various joint quality and bitrate control strategies for video encoding have been published. For example, see U.S. Pat. No. 5,686,964 to Naveen et al.; U.S. Pat. No. 5,995,151 to Naveen et al.; Caetano et al., "Rate Control Strategy for Embedded Wavelet Video Coders," IEEE Electronics Letters, pp 1815-17 (Oct. 14, 1999); Ribas-Corbera et al., "Rate Control in DCT Video Coding for Low-Delay Communications," IEEE Trans Circuits and Systems for Video Tech., Vol. 9, No 1, (February 1999); Westerink et al., "Two-pass MPEG-2 Variable Bit Rate Encoding," IBM Journal of Res. Dev., Vol. 43, No. 4 (July 1999); and Ortega et al., "Optimal Buffer-constrained Source Quantization and Fast Approximations," Proc. IEEE Intl. Symp. on Circ. and Sys., ISCAS '92, pp. 192-195 (1992). The Ortega article describes trellis-based coding for video.

As one might expect given the importance of quality and rate control to encoder performance, the fields of quality and rate control are well developed. Whatever the advantages of previous quality and rate control strategies, however, they do not offer the performance advantages of the present invention.

SUMMARY

The present invention relates to strategies for controlling the quality and bitrate of media such as audio data. For example, with a CBR control strategy, an audio encoder provides constant or relatively constant bitrate for variable quality output. The encoder overcomes the limitations of look-ahead buffers, while avoiding the computational difficulties of an exhaustive search. This improves the overall listening experience for many applications and makes computer systems a more compelling platform for creating, distributing, and playing back high quality stereo and multichannel audio. The CBR control strategies described herein include various techniques and tools, which can be used in combination or independently.

According to a first aspect of the control strategies described herein, an audio encoder encodes a sequence of audio data using a trellis in two-pass or delayed-decision encoding. The trellis includes multiple transitions. Each of the transitions corresponds to an encoding of a chunk of the audio data at a quality level. In this way, the encoder produces output of constant or relatively constant bitrate.

According to a second aspect of the control strategies described herein, an encoder (such as an audio encoder) encodes a sequence of data using a trellis. The encoder prunes the trellis according to a cost function. The cost function considers quality (e.g., noise to excitation ratio) and may also consider smoothness in quality changes. The encoder thus regulates bitrate by changing the quality of the output over time.

According to a third aspect of the control strategies described herein, an encoder encodes a sequence of data, stores encoded data for multiple portions of the sequence encoded at different quality levels, and determines a trace through the sequence. The trace includes a determination of a selected quality level for each of the portions. The encoder then stitches together parts of the stored encoded data to produce an output bitstream of the media data at constant or relatively constant bitrate. In this way, the encoder avoids having to re-encode the data after determining the trace.

According to a fourth aspect of the control strategies described herein, an encoder selects between two-pass and delayed-decision CBR encoding. This gives the encoder flexibility to address different encoding scenarios, for example, encoding input offline vs. streaming live input.

According to a fifth aspect of the control strategies described herein, an encoder performs delayed-decision CBR encoding using a trellis. The encoder prunes the trellis, if necessary, as it exits a delay window during the encoding. The encoder uses one or more criteria to prune the trellis. In this way, the encoder guarantees simplification of the trellis within the period of the delay window.

According to a sixth aspect of the control strategies described herein, an encoder performs CBR encoding using a trellis. The nodes of the trellis are based upon quantization of buffer fullness levels, which are a useful indicator of encoding state for the nodes of the trellis.

According to a seventh aspect of the control strategies described herein, an encoder uses one-pass CBR encoding as a fallback mode if there is a problem with two-pass or delayed-decision CBR encoding. In this way, the encoder produces valid output even if the two-pass or delayed-decision CBR encoding fail.

Additional features and advantages of the invention will be made apparent from the following detailed description of embodiments that proceeds with reference to the accompanying drawings.

DETAILED DESCRIPTION

An audio encoder uses one of the CBR control strategies described herein in encoding audio information. The audio encoder adjusts quantization of the audio information to satisfy constant or relatively constant bitrate requirements for a sequence of audio data. When making an encoding decision for a given portion of a sequence, the encoder considers actual encoding results for later portions of the sequence, while also limiting the computational complexity of the control strategy. With the control strategies described herein, a CBR audio encoder overcomes the limitations of look-ahead buffers. At the same time, the encoder avoids the computational difficulties of an exhaustive search.

The audio encoder uses several techniques in the CBR control strategy. While the techniques are typically described herein as part of a single, integrated system, the techniques can be applied separately in quality and/or rate control, potentially in combination with other rate control strategies.

In alternative embodiments, another type of audio processing tool implements one or more of the techniques to control the quality and/or bitrate of audio information. Moreover, although described embodiments focus on audio applications, in alternative embodiments, a video encoder, other media encoder, or other tool applies one or more of the techniques to control the quality and/or bitrate in a control strategy.

I. Computing Environment

Figure 3:
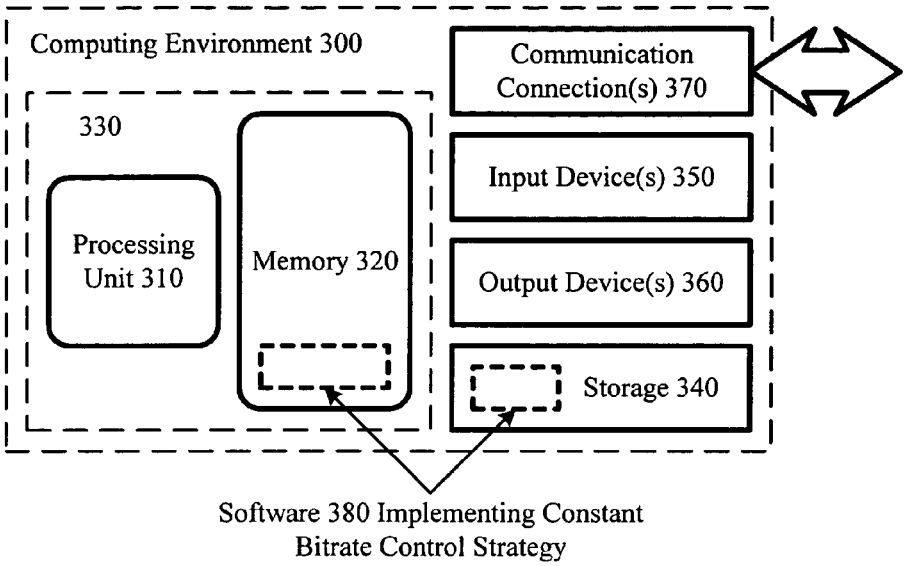
FIG. 3 is a block diagram of a suitable computing environment.

FIG. 3 illustrates a generalized example of a suitable computing environment (300) in which described embodiments may be implemented. The computing environment (300) is not intended to suggest any limitation as to scope of use or functionality of the invention, as the present invention may be implemented in diverse general-purpose or special-purpose computing environments.

With reference to FIG. 3, the computing environment (300) includes at least one processing unit (310) and memory (320). In FIG. 3, this most basic configuration (330) is included within a dashed line. The processing unit (310) executes computer-executable instructions and may be a real or a virtual processor. In a multi-processing system, multiple processing units execute computer-executable instructions to increase processing power. The memory (320) may be volatile memory (e.g., registers, cache, RAM), non-volatile memory (e.g., ROM, EEPROM, flash memory, etc.), or some combination of the two. The memory (320) stores software (380) implementing an audio encoder with a CBR control strategy.

A computing environment may have additional features. For example, the computing environment (300) includes storage (340), one or more input devices (350), one or more output devices (360), and one or more communication connections (370). An interconnection mechanism (not shown) such as a bus, controller, or network interconnects the components of the computing environment (300). Typically, operating system software (not shown) provides an operating environment for other software executing in the computing environment (300), and coordinates activities of the components of the computing environment (300).

The storage (340) may be removable or non-removable, and includes magnetic disks, magnetic tapes or cassettes, CD-ROMs, CD-RWs, DVDs, or any other medium which can be used to store information and which can be accessed within the computing environment (300). The storage (340)

stores instructions for the software (380) implementing the audio encoder with a CBR control strategy.

The input device(s) (350) may be a touch input device such as a keyboard, mouse, pen, or trackball, a voice input device, a scanning device, or another device that provides input to the computing environment (300). For audio, the input device(s) (350) may be a sound card or similar device that accepts audio input in analog or digital form, or a CD-ROM or CD-RW that provides audio samples to the computing environment. The output device(s) (360) may be a display, printer, speaker, CD-writer, or another device that provides output from the computing environment (300).

The communication connection(s) (370) enable communication over a communication medium to another computing entity. The communication medium conveys information such as computer-executable instructions, compressed audio or video information, or other data in a modulated data signal. A modulated data signal is a signal that has one or more of its characteristics set or changed in such a manner as to encode information in the signal. By way of example, and not limitation, communication media include wired or wireless techniques implemented with an electrical, optical, RF, infrared, acoustic, or other carrier.

The invention can be described in the general context of computer-readable media. Computer-readable media are any available media that can be accessed within a computing environment. By way of example, and not limitation, with the computing environment (300), computer-readable media include memory (320), storage (340), communication media, and combinations of any of the above.

The invention can be described in the general context of computer-executable instructions, such as those included in program modules, being executed in a computing environment on a target real or virtual processor. Generally, program modules include routines, programs, libraries, objects, classes, components, data structures, etc. that perform particular tasks or implement particular abstract data types. The functionality of the program modules may be combined or split between program modules as desired in various embodiments. Computer-executable instructions for program modules may be executed within a local or distributed computing environment.

For the sake of presentation, the detailed description uses terms like "determine," "generate," "adjust," and "apply" to describe computer operations in a computing environment. These terms are high-level abstractions for operations performed by a computer, and should not be confused with acts performed by a human being. The actual computer operations corresponding to these terms vary depending on implementation.

II. Exemplary Audio Encoders and Decoders

Figure 4:
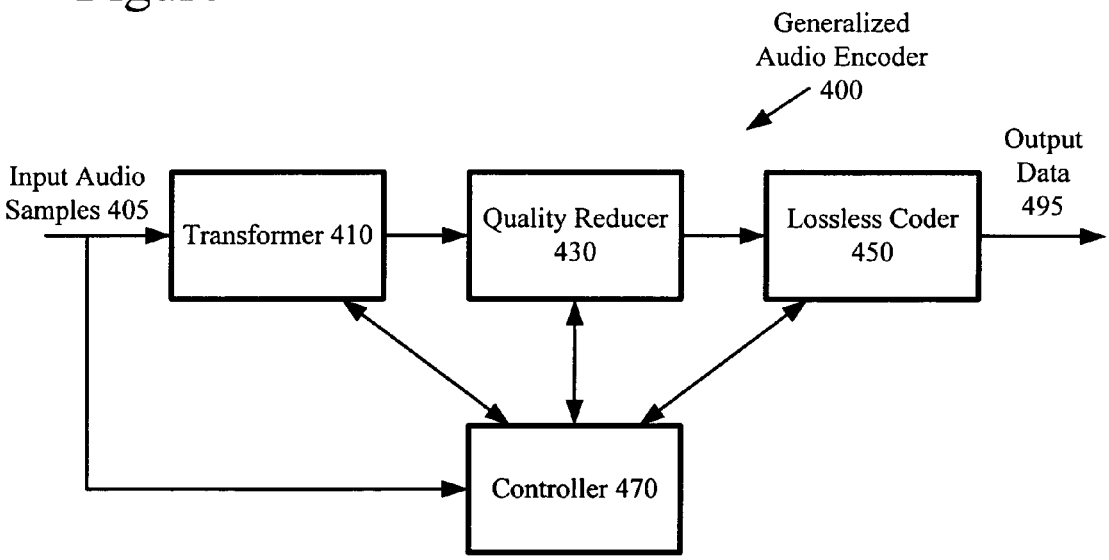
FIG. 4 is a block diagram of generalized audio encoder for one-pass encoding.
Figure 5:
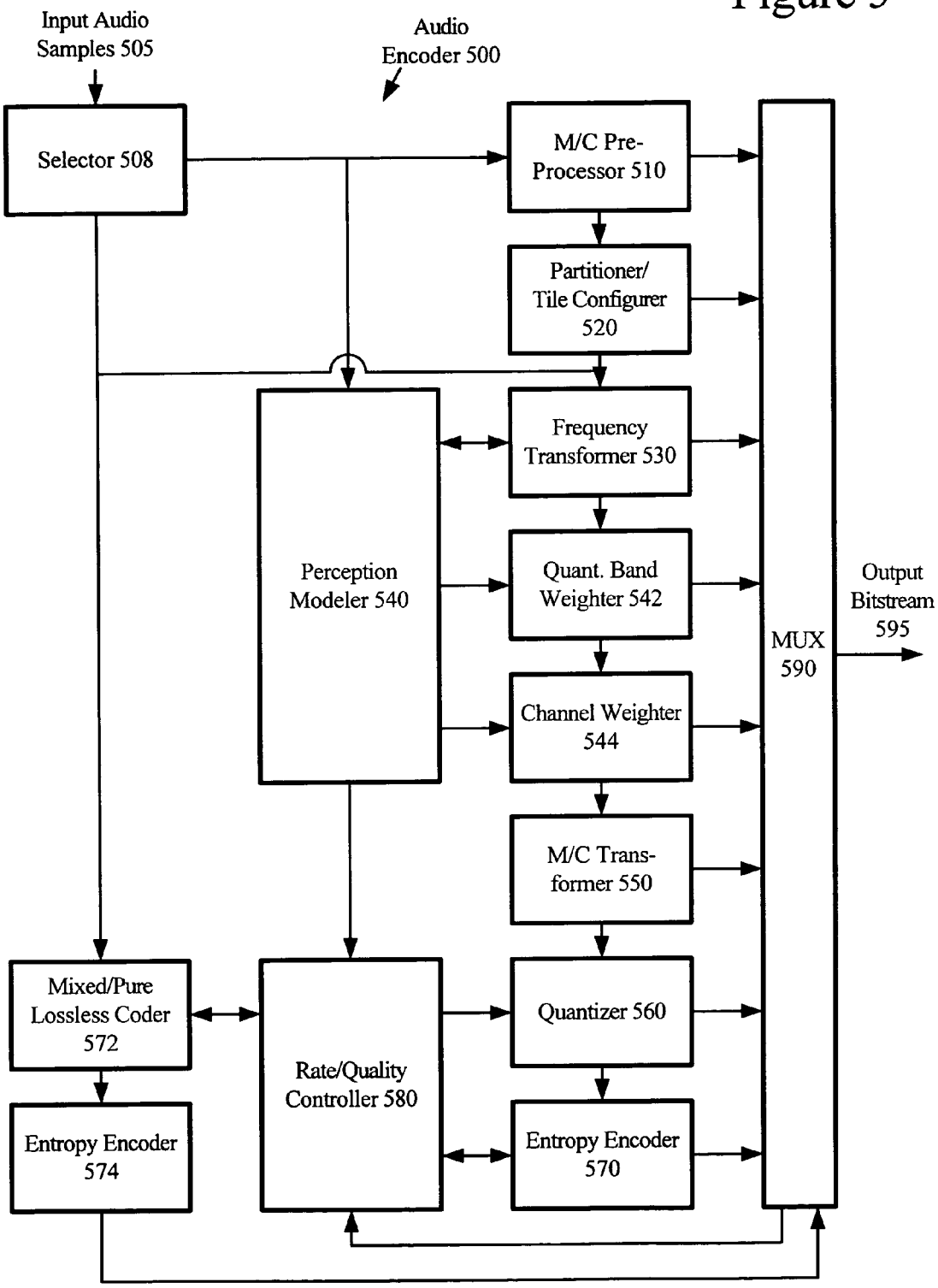
FIG. 5 is a block diagram of a particular audio encoder for one-pass encoding.
Figure 6:
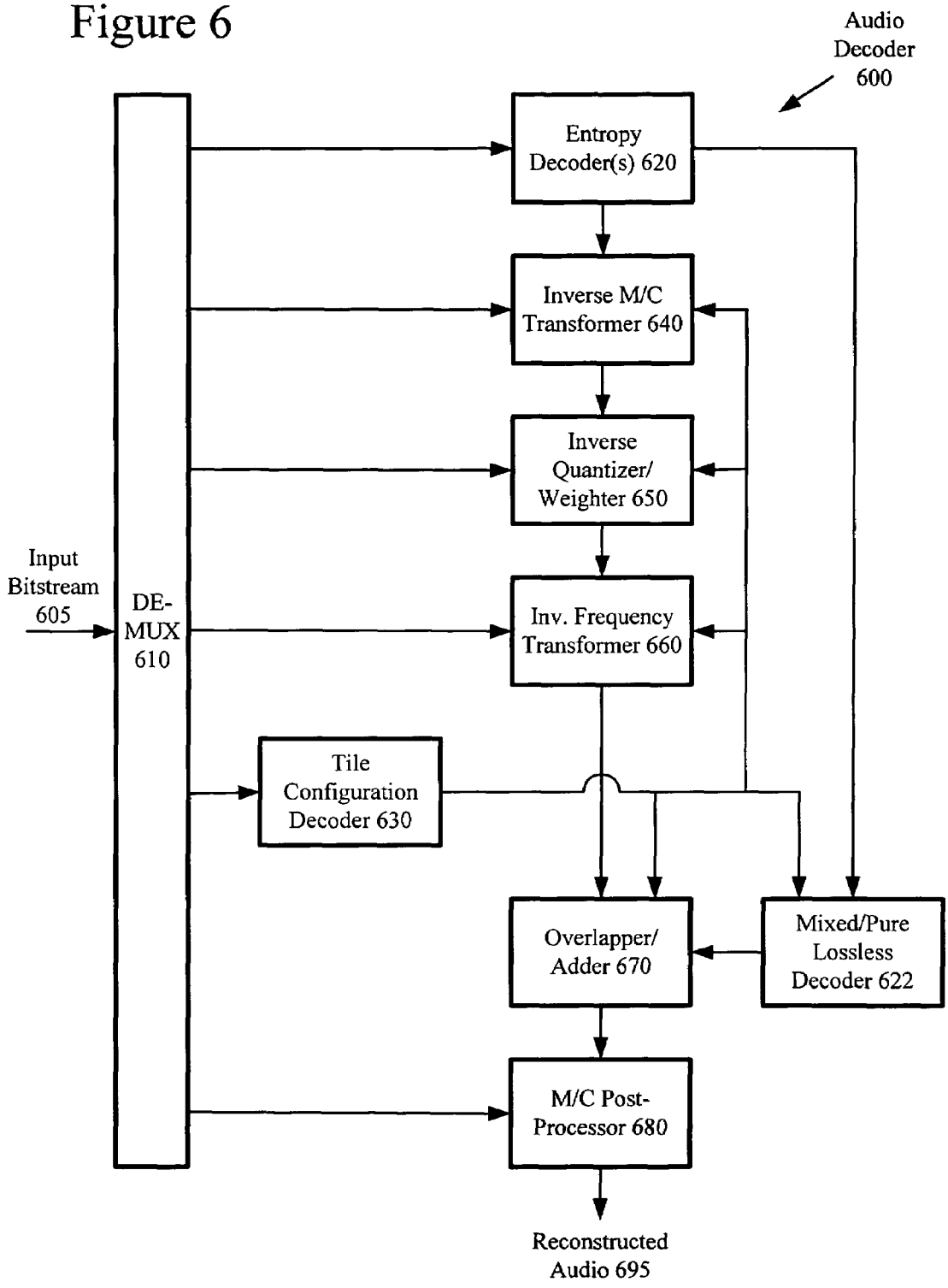
FIG. 6 is a block diagram of a corresponding audio decoder.

FIG. 4 shows a generalized audio encoder for one-pass encoding, in conjunction with which a CBR control strategy may be implemented. FIG. 5 shows a particular audio encoder for one-pass encoding, in conjunction with which the CBR control strategy may be implemented. FIG. 6 shows a corresponding audio decoder.

The relationships shown between modules within the encoders and decoder indicate the main flow of information in the encoders and decoder; other relationships are not shown for the sake of simplicity. Depending on implementation and the type of compression desired, modules of the encoders or decoder can be added, omitted, split into multiple modules, combined with other modules, and/or replaced with like modules. In alternative embodiments, an encoder with different modules and/or other configurations of modules controls quality and bitrate of compressed audio information.

A. Generalized Encoder

FIG. 4 is an abstraction of the encoder of FIG. 5 and encoders with other architectures and/or components. The generalized encoder (400) includes a transformer (410), a quality reducer (430), a lossless coder (450), and a controller (470).

The transformer (410) receives input data (405) and performs one or more transforms on the input data (405). The transforms may include prediction, time slicing, channel transforms, frequency transforms, or time-frequency tile generating subband transforms, linear or non-linear transforms, or any combination thereof.

The quality reducer (430) works in the transformed domain and reduces quality (i.e., introduces distortion) so as to reduce the output bitrate. By reducing quality carefully, the quality reducer (430) can lessen the perceptibility of the introduced distortion. A quantizer (scalar, vector, or other) is an example of a quality reducer (430). In many predictive coding schemes, the quality reducer (430) provides feedback to the transformer (410).

The lossless coder (450) is typically an entropy encoder that takes quantized indices as inputs and entropy codes the data for the final output bitstream.

The controller (470) determines the data transform to perform, output quality, and/or the entropy coding to perform, so as to meet constraints on the bitstream. The constraints may be on quality of the output, the bitrate of the output, latency in the system, overall file size, and/or other criteria.

Figure 1:
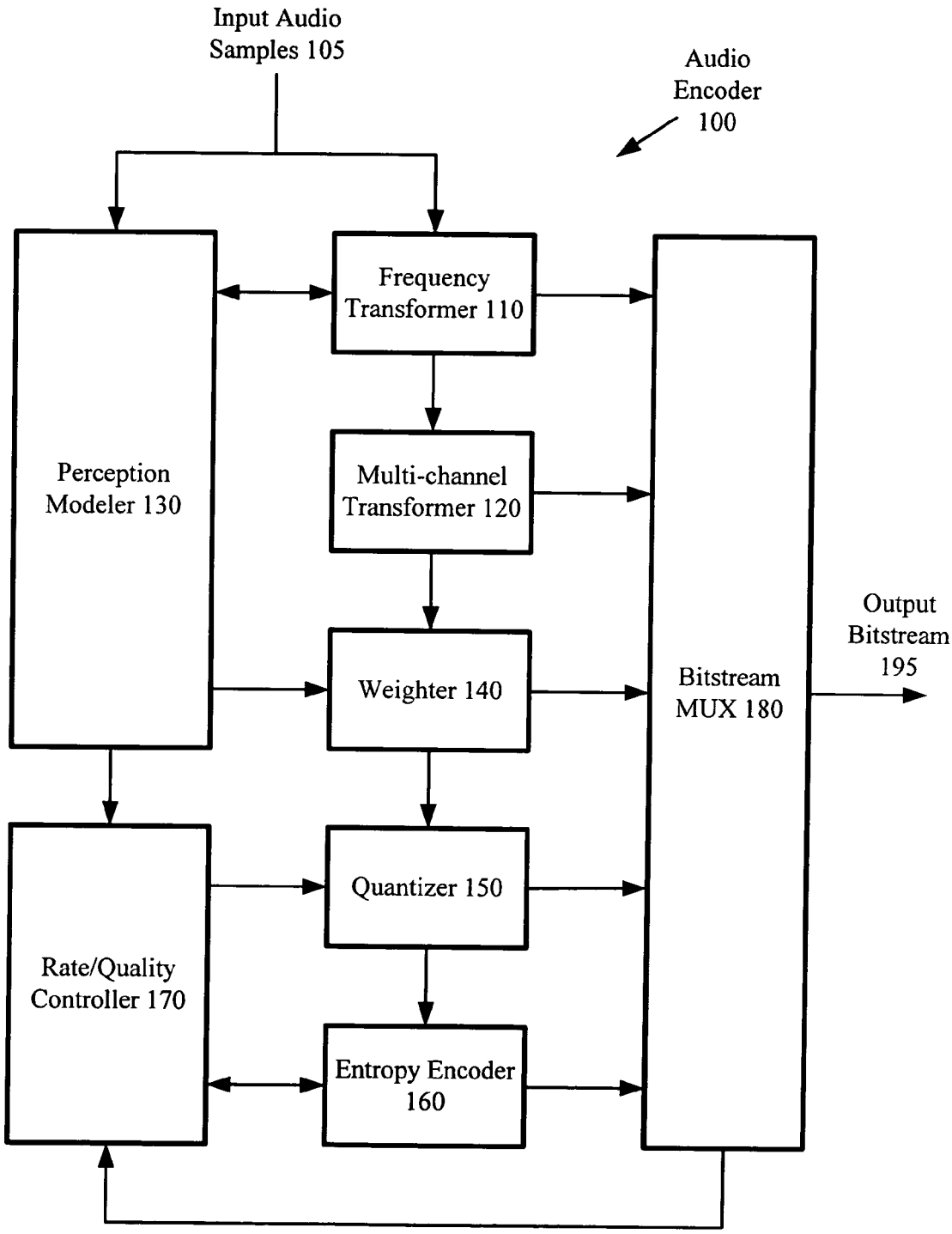
FIG. 1 is a block diagram of an audio encoder for one-pass encoding according to the prior art.
Figure 2:
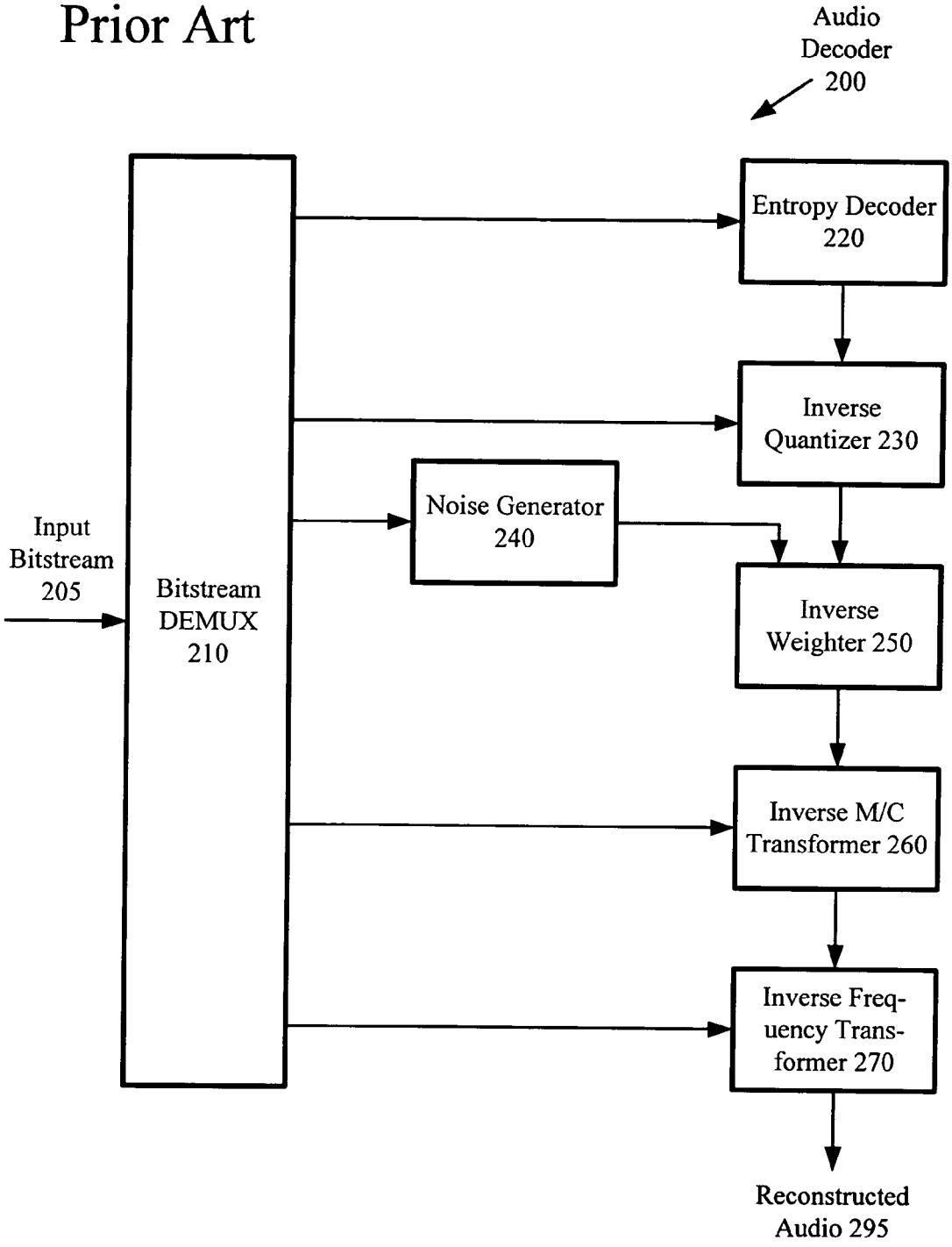
FIG. 2 is a block diagram of an audio decoder according to the prior art.

When used in conjunction with the control strategies described herein, the encoder (400) may take the form of a traditional, transform-based audio encoder such as the one shown in FIG. 1, an audio encoder having the architecture shown in FIG. 5, or another encoder.

B. Detailed Audio Encoder

With reference to FIG. 5, the audio encoder (500) includes a selector (508), a multi-channel pre-processor (510), a partitioner/tile configurer (520), a frequency transformer (530), a perception modeler (540), a weighter (542), a multi-channel transformer (550), a quantizer (560), an entropy encoder (570), a controller (580), a mixed/pure lossless coder (572) and associated entropy encoder (574), and a bitstream multiplexer ["MUX"] (590).

The encoder (500) receives a time series of input audio samples (505) at some sampling depth and rate in pulse code modulated ["PCM"] format. The input audio samples (505) are for multi-channel audio (e.g., stereo, surround) or for mono audio. The encoder (500) compresses the audio samples (505) and multiplexes information produced by the various modules of the encoder (500) to output a bitstream (595) in a format such as a WMA format or Advanced Streaming Format ["ASF"]. Alternatively, the encoder (500) works with other input and/or output formats.

The selector (508) selects between multiple encoding modes for the audio samples (505). In FIG. 5, the selector (508) switches between a mixed/pure lossless coding mode and a lossy coding mode. The lossless coding mode includes the mixed/pure lossless coder (572) and is typically used for high quality (and high bitrate) compression. The lossy coding mode includes components such as the weighter (542) and quantizer (560) and is typically used for adjustable quality (and controlled bitrate) compression. The selection decision at the selector (508) depends upon user input or other criteria. In certain circumstances (e.g., when lossy compression fails to deliver adequate quality or overproduces bits), the encoder (500) may switch from lossy coding over to mixed/pure lossless coding for a frame or set of frames.

For lossy coding of multi-channel audio data, the multi-channel pre-processor (510) optionally re-matrixes the time-domain audio samples (505). In some embodiments, the multi-channel pre-processor (510) selectively re-matrixes the audio samples (505) to drop one or more coded channels or increase inter-channel correlation in the encoder (500), yet allow reconstruction (in some form) in the decoder (600). This gives the encoder additional control over quality at the channel level. The multi-channel pre-processor (510) may send side information such as instructions for multi-channel post-processing to the MUX (590). Alternatively, the encoder (500) performs another form of multi-channel pre-processing.

The partitioner/tile configurer (520) partitions a frame of audio input samples (505) into sub-frame blocks (i.e., windows) with time-varying size and window shaping functions. The sizes and windows for the sub-frame blocks depend upon detection of transient signals in the frame, coding mode, as well as other factors.

If the encoder (500) switches from lossy coding to mixed/pure lossless coding, sub-frame blocks need not overlap or have a windowing function in theory (i.e., non-overlapping, rectangular-window blocks), but transitions between lossy coded frames and other frames may require special treatment. The partitioner/tile configurer (520) outputs blocks of partitioned data to the mixed/pure lossless coder (572) and outputs side information such as block sizes to the MUX (590).

When the encoder (500) uses lossy coding, variable-size windows allow variable temporal resolution. Small blocks allow for greater preservation of time detail at short but active transition segments. Large blocks have better frequency resolution and worse time resolution, and usually allow for greater compression efficiency at longer and less active segments, in part because frame header and side information is proportionally less than in small blocks, and in part because it allows for better redundancy removal. Blocks can overlap to reduce perceptible discontinuities between blocks that could otherwise be introduced by later quantization. The partitioner/tile configurer (520) outputs blocks of partitioned data to the frequency transformer (530) and outputs side information such as block sizes to the MUX (590). Alternatively, the partitioner/tile configurer (520) uses other partitioning criteria or block sizes when partitioning a frame into windows.

In some embodiments, the partitioner/tile configurer (520) partitions frames of multi-channel audio on a per-channel basis. The partitioner/tile configurer (520) independently partitions each channel in the frame, if quality/bitrate allows. This allows, for example, the partitioner/tile configurer (520) to isolate transients that appear in a particular channel with smaller windows, but use larger windows for frequency resolution or compression efficiency in other channels. This can improve compression efficiency by isolating transients on a per channel basis, but additional information specifying the partitions in individual channels is needed in many cases. Windows of the same size that are co-located in time may qualify for further redundancy reduction through multi-channel transformation. Thus, the partitioner/tile configurer (520), groups windows of the same size that are co-located in time as a tile.

The frequency transformer (530) receives audio samples and converts them into data in the frequency domain. The frequency transformer (530) outputs blocks of frequency coefficient data to the weighter (542) and outputs side information such as block sizes to the MUX (590). The frequency transformer (530) outputs both the frequency coefficients and the side information to the perception modeler (540). In some embodiments, the frequency transformer (530) applies a time-varying Modulated Lapped Transform ["MLT"] MLT to the sub-frame blocks, which operates like a DCT modulated by the sine window function(s) of the sub-frame blocks. Alternative embodiments use other varieties of MLT, or a DCT or other type of modulated or non-modulated, overlapped or non-overlapped frequency transform, or use subband or wavelet coding.

The perception modeler (540) models properties of the human auditory system to improve the perceived quality of the reconstructed audio signal for a given bitrate. Generally, the perception modeler (540) processes the audio data according to an auditory model, then provides information to the weighter (542) which can be used to generate weighting factors for the audio data. The perception modeler (540) uses any of various auditory models and passes excitation pattern information or other information to the weighter (542).

The quantization band weighter (542) generates weighting factors for quantization matrices based upon the information received from the perception modeler (540) and applies the weighting factors to the data received from the frequency transformer (530). The weighting factors for a quantization matrix include a weight for each of multiple quantization bands in the audio data. The quantization bands can be the same or different in number or position from the critical bands used elsewhere in the encoder (500), and the weighting factors can vary in amplitudes and number of quantization bands from block to block. The quantization band weighter (542) outputs weighted blocks of coefficient data to the channel weighter (543) and outputs side information such as the set of weighting factors to the MUX (590). The set of weighting factors can be compressed for more efficient representation. If the weighting factors are lossy compressed, the reconstructed weighting factors are typically used to weight the blocks of coefficient data. Alternatively, the encoder (500) uses another form of weighting or skips weighting.

The channel weighter (543) generates channel-specific weight factors (which are scalars) for channels based on the information received from the perception modeler (540) and also on the quality of locally reconstructed signal. The scalar weights (also called quantization step modifiers) allow the encoder (500) to give the reconstructed channels approximately uniform quality. The channel weight factors can vary in amplitudes from channel to channel and block to block, or at some other level. The channel weighter (543) outputs weighted blocks of coefficient data to the multi-channel transformer (550) and outputs side information such as the set of channel weight factors to the MUX (590). The channel weighter (543) and quantization band weighter (542) in the flow diagram can be swapped or combined together. Alternatively, the encoder (500) uses another form of weighting or skips weighting.

For multi-channel audio data, the multiple channels of noise-shaped frequency coefficient data produced by the channel weighter (543) often correlate, so the multi-channel transformer (550) may apply a multi-channel transform. For example, the multi-channel transformer (550) selectively and flexibly applies the multi-channel transform to some but not all of the channels and/or quantization bands in the tile. This gives the multi-channel transformer (550) more precise control over application of the transform to relatively correlated parts of the tile. To reduce computational complexity, the multi-channel transformer (550) may use a hierarchical transform rather than a one-level transform. To reduce the bitrate associated with the transform matrix, the multi-channel transformer (550) selectively uses pre-defined matrices (e.g., identity/no transform, Hadamard, DCT Type II) or custom matrices, and applies efficient compression to the custom matrices. Finally, since the multi-channel transform is downstream from the weighter (542), the perceptibility of noise (e.g., due to subsequent quantization) that leaks between channels after the inverse multi-channel transform in the decoder (600) is controlled by inverse weighting. Alternatively, the encoder (500) uses other forms of multi-channel transforms or no transforms at all. The multi-channel transformer (550) produces side information to the MUX (590) indicating, for example, the multi-channel transforms used and multi-channel transformed parts of tiles.

The quantizer (560) quantizes the output of the multi-channel transformer (550), producing quantized coefficient data to the entropy encoder (570) and side information including quantization step sizes to the MUX (590). In FIG. 5, the quantizer (560) is an adaptive, uniform, scalar quantizer that computes a quantization factor per tile. The tile quantization factor can change from one iteration of a quantization loop to the next to affect the bitrate of the entropy encoder (560) output, and the per-channel quantization step modifiers can be used to balance reconstruction quality between channels. In alternative embodiments, the quantizer is a non-uniform quantizer, a vector quantizer, and/or a non-adaptive quantizer, or uses a different form of adaptive, uniform, scalar quantization. In other alternative embodiments, the quantizer (560), quantization band weighter (542), channel weighter (543), and multi-channel transformer (550) are fused and the fused module determines various weights all at once.

The entropy encoder (570) losslessly compresses quantized coefficient data received from the quantizer (560). In some embodiments, the entropy encoder (570) uses adaptive entropy encoding that switches between level and run length/level modes Alternatively, the entropy encoder (570) uses some other form or combination of multi-level run length coding, variable-to-variable length coding, run length coding, Huffinan coding, dictionary coding, arithmetic coding, LZ coding, or some other entropy encoding technique. The entropy encoder (570) can compute the number of bits spent encoding audio information and pass this information to the rate/quality controller (580).

The controller (580) works with the quantizer (560) to regulate the bitrate and/or quality of the output of the encoder (500). The controller (580) receives information from other modules of the encoder (500) and processes the received information to determine desired quantization factors given current conditions. The controller (570) outputs the quantization factors to the quantizer (560) with the goal of satisfying quality and/or bitrate constraints. When the encoder is used in conjunction with a CBR control strategy described below, the controller (580) regulates compression at different quality levels (e.g., by quantization steps sizes) for each of multiple chunks of audio data. The controller (580) records and processes information about the bits produced, buffer fullness levels, and qualities at the different quality levels. It may then apply selected quality levels to the chunks in a second pass.

The mixed/pure lossless encoder (572) and associated entropy encoder (574) compress audio data for the mixed/pure lossless coding mode. The encoder (500) uses the mixed/pure lossless coding mode for an entire sequence or switches between coding modes on a frame-by-frame, block-by-block, tile-by-tile, or other basis. Alternatively, the encoder (500) uses other techniques for mixed and/or pure lossless encoding.

The MUX (590) multiplexes the side information received from the other modules of the audio encoder (500) along with the entropy encoded data received from the entropy encoders (570, 574). The MUX (590) outputs the information in a WMA format or another format that an audio decoder recognizes. The MUX (590) may include a virtual buffer that stores the bitstream (595) to be output by the encoder (500). The current fullness and other characteristics of the buffer can be used by the controller (580) to regulate quality and/or bitrate.

C. Detailed Audio Decoder

With reference to FIG. 6, a corresponding audio decoder (600) includes a bitstream demultiplexer ["DEMUX"] (610), one or more entropy decoders (620), a mixed/pure lossless decoder (622), a tile configuration decoder (630), an inverse multi-channel transformer (640), a inverse quantizer/weighter (650), an inverse frequency transformer (660), an overlapper/adder (670), and a multi-channel post-processor (680). The decoder (600) is somewhat simpler than the encoder (600) because the decoder (600) does not include modules for rate/quality control or perception modeling.

The decoder (600) receives a bitstream (605) of compressed audio information in a WMA format or another format. The bitstream (605) includes entropy encoded data as well as side information from which the decoder (600) reconstructs audio samples (695).

The DEMUX (610) parses information in the bitstream (605) and sends information to the modules of the decoder (600). The DEMUX (610) includes one or more buffers to compensate for variations in bitrate due to fluctuations in complexity of the audio, network jitter, and/or other factors.

The one or more entropy decoders (620) losslessly decompress entropy codes received from the DEMUX (610). The entropy decoder (620) typically applies the inverse of the entropy encoding technique used in the encoder (500). For the sake of simplicity, one entropy decoder module is shown in FIG. 6, although different entropy decoders may be used for lossy and lossless coding modes, or even within modes. Also, for the sake of simplicity, FIG. 6 does not show mode selection logic. When decoding data compressed in lossy coding mode, the entropy decoder (620) produces quantized frequency coefficient data.

The mixed/pure lossless decoder (622) and associated entropy decoder(s) (620) decompress losslessly encoded audio data for the mixed/pure lossless coding mode. Alternatively, decoder (600) uses other techniques for mixed and/or pure lossless decoding.

The tile configuration decoder (630) receives and, if necessary, decodes information indicating the patterns of tiles for frames from the DEMUX (690). The tile pattern information may be entropy encoded or otherwise parameterized. The tile configuration decoder (630) then passes tile pattern information to various other modules of the decoder (600). Alternatively, the decoder (600) uses other techniques to parameterize window patterns in frames.

The inverse multi-channel transformer (640) receives the quantized frequency coefficient data from the entropy decoder (620) as well as tile pattern information from the tile configuration decoder (630) and side information from the DEMUX (610) indicating, for example, the multi-channel transform used and transformed parts of tiles. Using this information, the inverse multi-channel transformer (640) decompresses the transform matrix as necessary, and selectively and flexibly applies one or more inverse multi-channel transforms to the audio data. The placement of the inverse multi-channel transformer (640) relative to the inverse quantizer/weighter (640) helps shape quantization noise that may leak across channels.

The inverse quantizer/weighter (650) receives tile and channel quantization factors as well as quantization matrices from the DEMUX (610) and receives quantized frequency coefficient data from the inverse multi-channel transformer (640). The inverse quantizer/weighter (650) decompresses the received quantization factor/matrix information as necessary, then performs the inverse quantization and weighting. In alternative embodiments, the inverse quantizer/weighter applies the inverse of some other quantization techniques used in the encoder.

The inverse frequency transformer (660) receives the frequency coefficient data output by the inverse quantizer/weighter (650) as well as side information from the DEMUX (610) and tile pattern information from the tile configuration decoder (630). The inverse frequency transformer (670) applies the inverse of the frequency transform used in the encoder and outputs blocks to the overlapper/adder (670).

In addition to receiving tile pattern information from the tile configuration decoder (630), the overlapper/adder (670) receives decoded information from the inverse frequency transformer (660) and/or mixed/pure lossless decoder (622). The overlapper/adder (670) overlaps and adds audio data as necessary and interleaves frames or other sequences of audio data encoded with different modes. Alternatively, the decoder (600) uses other techniques for overlapping, adding, and interleaving frames.

The multi-channel post-processor (680) optionally re-matrixes the time-domain audio samples output by the overlapper/adder (670). The multi-channel post-processor selectively re-matrixes audio data to create phantom channels for playback, perform special effects such as spatial rotation of channels among speakers, fold down channels for playback on fewer speakers, or for any other purpose. For bitstream-controlled post-processing, the post-processing transform matrices vary over time and are signaled or included in the bitstream (605). Alternatively, the decoder (600) performs another form of multi-channel post-processing.

III. CBR Control Strategies

An audio encoder produces CBR output using a delayed-decision or multi-pass control strategy. When making an encoding decision for a given chunk of audio data, the encoder consider the results of actual encoding of later chunks of audio data, which allows the encoder to more reliably allocate bits for the given chunk of audio data. At the same time, the encoder limits the computational complexity of the control strategy. Thus, the audio encoder effectively regulates bitrate while smoothly adjusting quality in a computationally manageable solution.

In general, in a two-pass control strategy, an encoder analyzes input during a first pass to estimate the complexity of the entire input, and then decides a strategy for compression. During a second pass, the encoder applies this strategy to generate the actual bitstream. In contrast, in a one-pass control strategy, an encoder looks at the input signal once and generates a compressed bitstream. A delayed-decision control strategy is somewhere in the middle. The process details of a control strategy (whether in a one-pass, two-pass, or delayed-decision solution) depend on the constraints placed on the output.

If the generated bitstream is to be streamed over CBR channels, the encoder places a CBR constraint on the output, for example, that if the output compressed bitstream is read into a decoder buffer at a constant bitrate the decoder buffer should neither overflow nor underflow. The decoder buffer can be at full state, but that condition is unsafe due to the chance of buffer overflow. For purposes of modeling the decoder buffer, the decoder is assumed to be an idealized decoder in that it decodes data instantaneously, while playing back the decoded data in real time.

Figure 7:
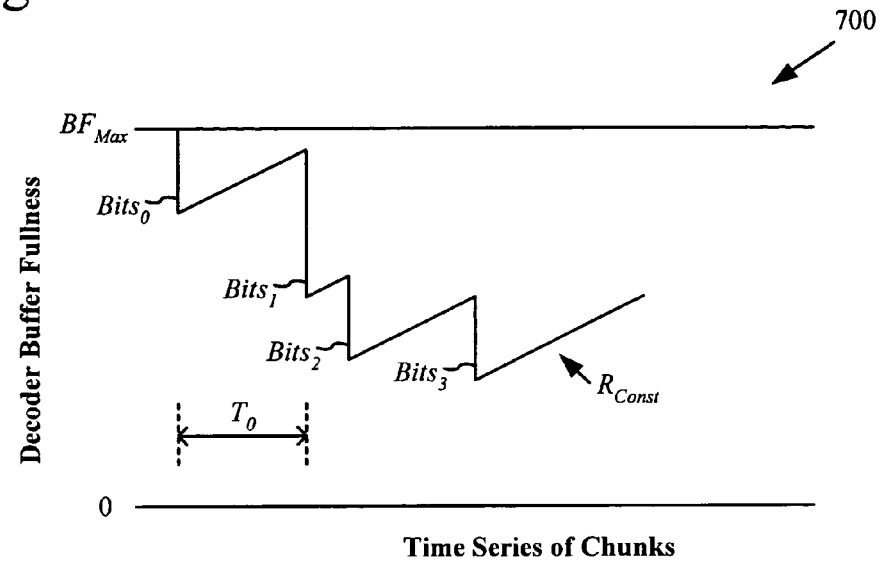
FIG. 7 is a graph of a trajectory of decoder buffer fullness in a CBR control strategy.

One model for CBR encoding includes a hypothetical decoder buffer of size $BF_{Max}$ that is filled at a constant rate of $R_{Const}$ bits/second. FIG. 7 shows a graph (700) of a trajectory of decoder buffer fullness in a CBR control strategy. The horizontal axis represents a time series of chunks of audio data, and the vertical axis represents a range of decoder buffer fullness values. A chunk is a block of input such as a frame, sub-frame, or tile. Chunks can have different presentation durations and compressed bits sizes, and all chunks need not have the same presentation duration in a sequence of audio data. (This is in contrast with typical video coding applications, where frames are regularly spaced and have constant size.)

According to the model, a decoder draws compressed bits from the buffer for a chunk (e.g., $Bits_0$ for chunk 0, $Bits_1$ for chunk 1, etc.), decodes, and presents the decoded samples. The act of drawing compressed bits is assumed to be instantaneous. Compressed bits are added to the buffer at the rate of $R_{Const}$. So, over the duration $T_0$ of chunk 0, the encoder adds $R_{Const} \cdot T_0$ bits. Alternatively, the encoder uses a different decoder buffer model, for example, one modeling different or additional constraints.

A. General Strategy for Two-Pass or Delayed-Decision CBR Encoding

Figure 8:
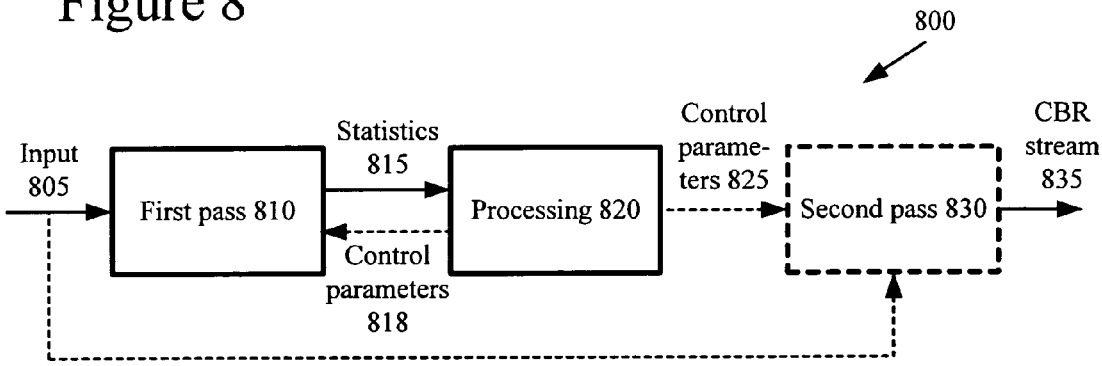
FIG. 8 is a flowchart of a general strategy for two-pass or delayed-decision CBR encoding.

FIG. 8 shows a general strategy (800) for two-pass or delayed-decision CBR encoding. The strategy can be realized in conjunction with a one-pass audio encoder such as the one-pass encoder (500) of FIG. 5, the one-pass encoder (100) of FIG. 1, or another implementation of the encoder (400) of FIG. 4. No special decoder is needed.

Like the other flowcharts described herein, FIG. 8 shows the main flow of information; other relationships are not shown for the sake of simplicity. Depending on implementation, stages can be added, omitted, split into multiple stages, combined with other stages, and/or replaced with like stages. In alternative embodiments, an encoder uses a strategy with different stages and/or other configurations of stages to control quality and/or bitrate.

Several stages of the strategy (800) compute or use a quality measure for a block that indicates the quality for the block. The quality measure is typically expressed in terms of NER. Actual NER values may be computed from noise patterns and excitation patterns for blocks, or suitable NER values for blocks may be estimated based upon complexity, bitrate, and other factors. For additional detail about NER and NER computation, see U.S. patent application Ser. No. 10/017,861, filed Dec. 14, 2001, entitled "Techniques for Measurement of Perceptual Audio Quality," published on Jun. 19, 2003, as Publication No. US-2003-0115042-A1, the disclosure of which is hereby incorporated by reference. More generally, stages of the strategy (800) compute quality measures based upon available information, and can use measures other than NER for objective or perceptual quality.

Returning to FIG. 8, in a first pass (810), the encoder encodes the input (805) at different quality levels and gathers statistics (815) regarding the encoded input. For example, the encoder encodes the input (805) at different quantization step sizes and produces statistics (815) relating to quantization step size, bitrate, NER, and buffer fullness levels for the different quantization step sizes. The encoder may compute other and/or addition statistics as well. The encoder encodes the input (805) using the normal components and techniques for the encoder. For example, the encoder (500) of FIG. 5 performs transient detection, determines tile configurations, determines playback durations for tiles, decides channel transforms, determines channel masks, etc.

The encoder may store the actual compressed data (here, the quantized and entropy encoded data) resulting from encoding the input (805) at different quality levels. Or, instead of storing actual compressed data, the encoder may store auxiliary information, which is side information resulting from analysis of the audio data by the encoder. The auxiliary information generally includes frame partitioning information, perceptual weight values, and channel transform information. The encoder will use the stored information in the second pass to speed up encoding in the second pass. Alternatively, the encoder discards auxiliary information and re-computes it in the second pass.

The encoder processes (820) the statistics (815) to determine which quality levels to use in encoding different parts of the input (805), so as to produce the desired CBR stream (835). For example, for each of multiple chunks of the input (805), the encoder selects a quantization step size to use for the chunk.

During the processing (820), the encoder tracks one or more different traces through the sequence of input (805), where each trace is a history of encoding decisions (e.g., quantization step size decisions) up to the present time in the sequence. For example, for each chunk of the input (805) up to the present, a given trace indicates a selected quantization step size used in encoding. The trace also has an associated current buffer fullness level as a result of those decisions. A different trace reflects different encoding decisions, indicating different quantization step sizes and/or a different current buffer fullness.

The encoder may perform the processing (820) after the completion of the first pass. Or, the encoder may use control parameters (818), derived from the processing (820), to affect the encoding in the first pass (810). In this way, the first pass (810) and the processing stage (820) occur in a feedback loop, such that the first pass (810) influences and is influenced by the results of the processing stage (820). For example, the control parameters (818) change which quality levels the encoder tests in the first pass (810) for the next part of the input (805). Or, the control parameters (818) allow the encoder to discard stored encoded data from previous parts of the input (805) when that stored encoded data is not part of any extant trace through the input (805).

After the first pass (810) ends, the encoder processes (820) the statistics (815) to finalize the determination about which quality levels to use in encoding different parts of the input (805), so as to produce the desired CBR stream (835). For example, the encoder finalizes the decision about which quantization step sizes to use for the different chunks of the input (805), in effect selecting a "winning" trace through the sequence of input (805). If the encoder has not stored encoded data for the selected trace, the encoder uses control parameters (825) to encode the input (805) in a second pass (820), distributing the available bits over different parts of the input (805) such that constant or approximately constant bitrate is obtained in the output CBR bitstream (835). The control parameters (825) indicate the final determination about which quality levels to use in encoding different parts of the input (805). The encoder might perform the second pass (830), for example, to reduce costs of intermediate storage of encoded data, or because encoding dependencies between different parts of the input (805) preclude final encoding before selection of the winning trace. FIG. 8 shows these operations in dashed lines, however, since the encoder may bypass the operations as described below.

Figure 9:
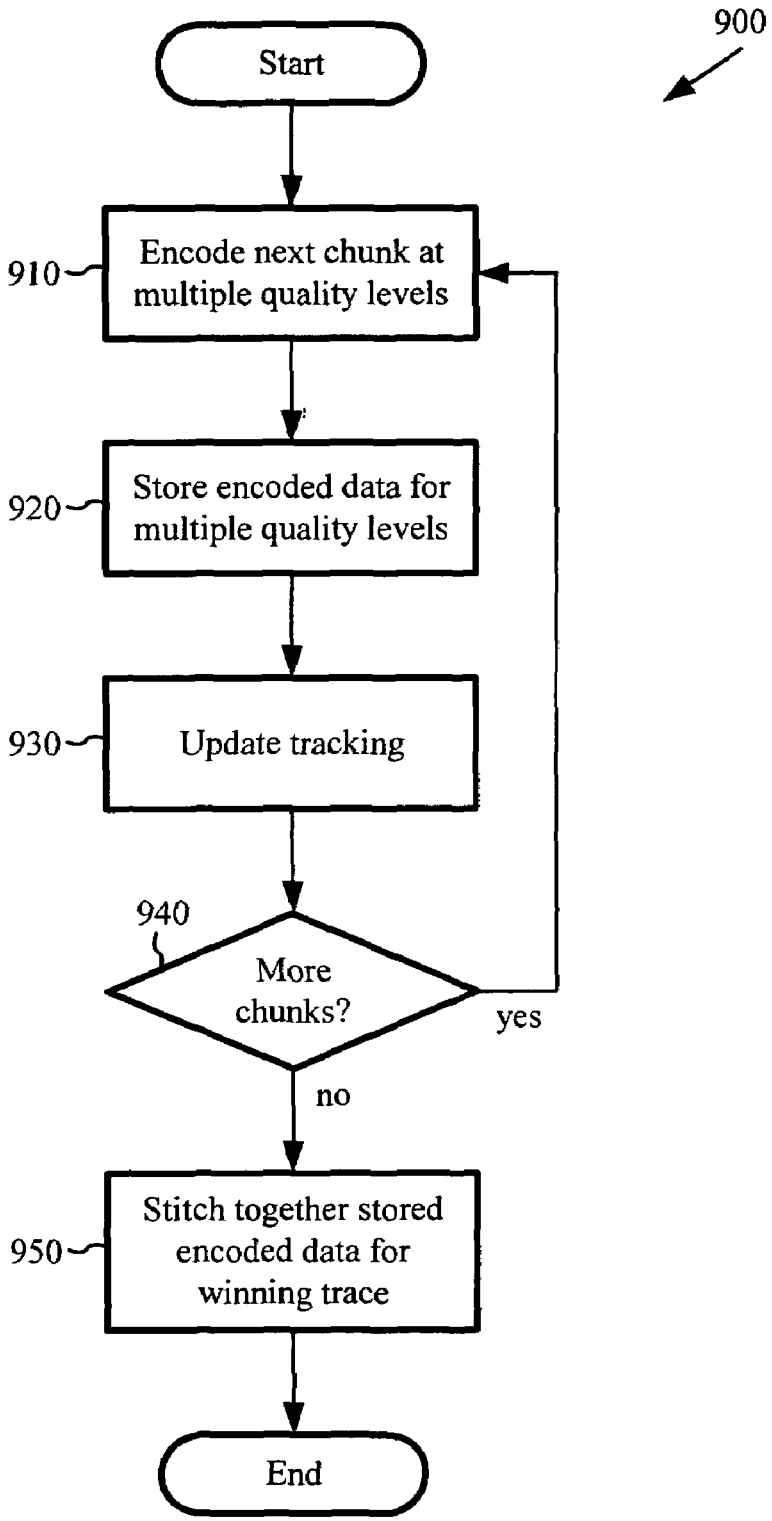
FIG. 9 is a flowchart showing a technique for stitching together encoded chunks of data stored in a first pass of CBR encoding.

If the encoder has stored encoded data for the selected trace during the first pass (810), the encoder may simply stitch together the different parts of the selected trace as the output CBR stream (835). FIG. 9 shows a technique (900) for stitching together encoded chunks of data stored in a first pass of CBR encoding.

For a given chunk of data, the encoder encodes (910) the chunk at multiple quality levels. For example, the encoder uses different quantization step sizes to encode a tile of multi-channel audio data in an audio sequence. The encoder stores (920) encoded data for the multiple quality levels.

The encoder then updates (930) the tracking of one or more different traces through the sequence. Different traces reflect different encoding decisions (e.g., quantization step size decisions) for chunks up to the current chunk. By updating (930) the tracking, the encoder is able to discard some of the encoded data that was previously stored (920). For example, the encoder discards the encoded data for a chunk at a particular quality level if that encoded data is not part of any surviving trace after the updating (930).

The encoder then determines (940) whether there are any more chunks in the sequence. If so, the encoder continues by encoding (910) the next chunk. Otherwise, the encoder stitches (950) together stored encoded data for a winning trace through the sequence. For example, in an output bitstream, the encoder concatenates encoded data at a selected quality level for each chunk, respectively, along with other elements of the bitstream.

B. Tree-structured Encoding and Trellis Encoding, Generally

In some embodiments, the encoder uses a variation of trellis coding for CBR encoding. With the trellis coding, the encoder maintains one or more traces through audio input and compares the desirability of different traces during the encoding. The encoder removes traces or parts of traces deemed less desirable than other traces. In this way, the encoder evaluates actual encoding results for different quality levels (as opposed to just estimating complexity as in a look-ahead buffer) while also controlling computational complexity (by removing traces or parts of traces).

Trellis coding uses tree structures to trace candidate representations of an input audio sequence. To illustrate, suppose the input is organized as N chunks in the intervals $I_1, I_2, \ldots, I_N$. Also suppose that there are M possible quality levels for each chunk, so the chunk in the $n^{th}$ interval $I_n$ can be represented in M possible qualities $Q_1, Q_2, \ldots, Q_M$. The coded representation of the chunk in the $n^{th}$ interval $I_n$ at quality $Q_m$ is $C_{n,m}$.

Figure 10:
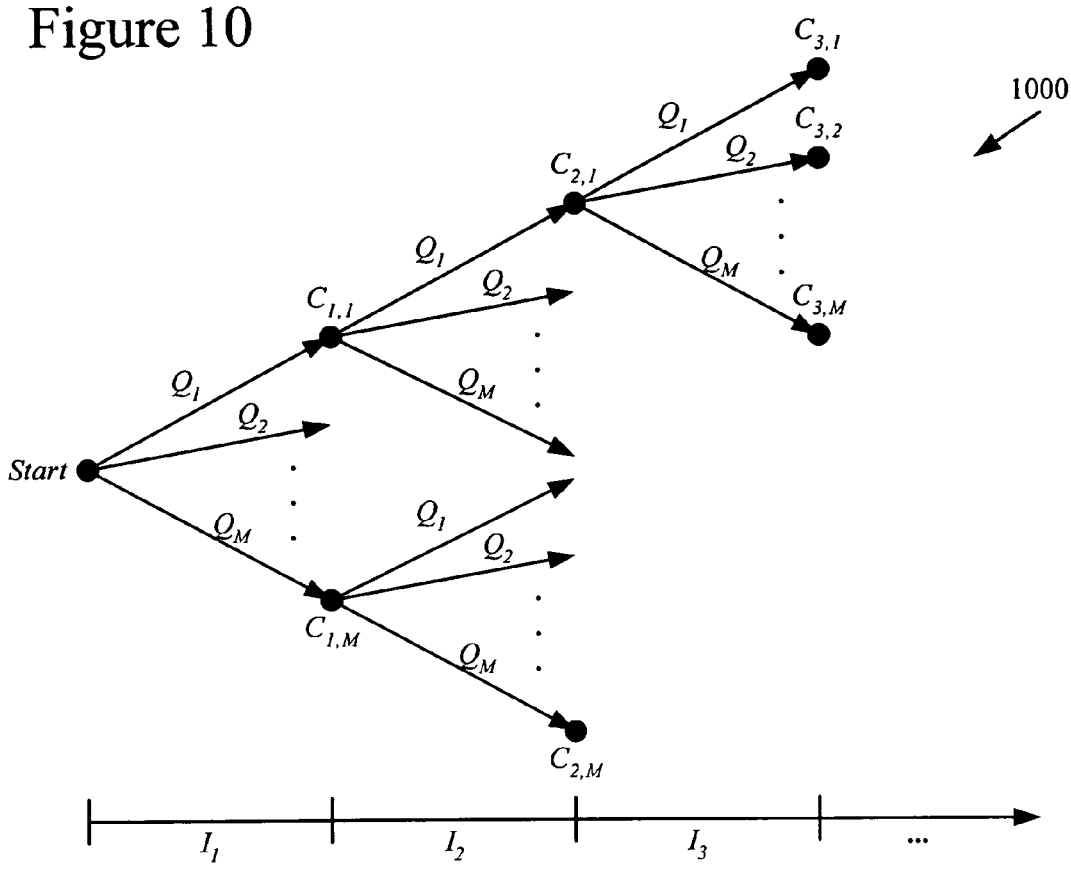
FIG. 10 is a diagram showing the evolution of possible traces of coded representations of audio input in a tree-structure approach.

FIG. 10 shows a tree-like evolution of possible traces of coded representations of audio input. In FIG. 10, the intervals are uniformly sized for the sake of simplicity. Chunks of input may have variable durations. The overall coded representation of an audio input sequence can be modeled as a concatenation of coded representations of the chunks in the sequence. (In reality, there may also be syntactic elements interleaved between the different coded chunks in the sequence.) For example, the coded sequence $C_{1,1}$, $C_{2,1}$, $C_{3,1}$, . . . is one candidate representation of the sequence. $C_{1,1}$, $C_{2,1}$, $C_{3,M}$, . . . is another candidate representation. The goal of the encoder is to select the best trace through the code chunks according to some criteria, while obeying CBR constraints.

Unless checked, the number of candidate representations of the input grows exponentially as the number of stages (i.e., chunks) increases. Some of these traces likely fail one or more constraints put on the encoding, however. Typical constraints include:

(1) each coded chunk should have a certain minimum quality;

(2) each coded chunk should not take up more than a certain number of bits;

(3) when the composite (i.e., concatenated) bitstream is streamed over a CBR channel, the decoder buffer should neither overflow nor underflow; and/or (4) changes in quality should be as smooth as possible.

The encoder may consider other and/or additional constraints.

Suppose n−1 input chunks have been processed, and that there are $L_{n-1}$ possible concatenated streams that satisfy the applicable constraints. At the $n^{th}$ stage of encoding, the input chunk in the interval $I_n$ is coded at M quality levels. Then, these M compressed representations of the $n^{th}$ chunk are concatenated with each one of the $L_{n-1}$ possible concatenated streams from stage n−1. This results in $M \cdot L_{n-1}$ candidate representations of the input sequence up to and including stage n. The encoder tests the applicable constraints on these $M \cdot L_{n-1}$ candidates, and only the $L_n$ candidates that satisfy the constraints survive for the next input stage (i.e., the stage n+1). Typically, $L_n$ is less than $M \cdot L_{n-1}$, as some candidate traces get pruned for failure to satisfy one or more of the constraints.

At the end of the coding, after all N input chunks have been processed, $L_N$ candidate compressed streams remain. Of these, the encoder chooses the best stream according to some criteria. For a large N, $L_N$ can be much smaller than $M^N$ but still be extremely large. To reduce computational complexity, the encoder places additional constraints on the compressed streams and uses heuristics to limit $L_n$ at each stage.

Figure 11:
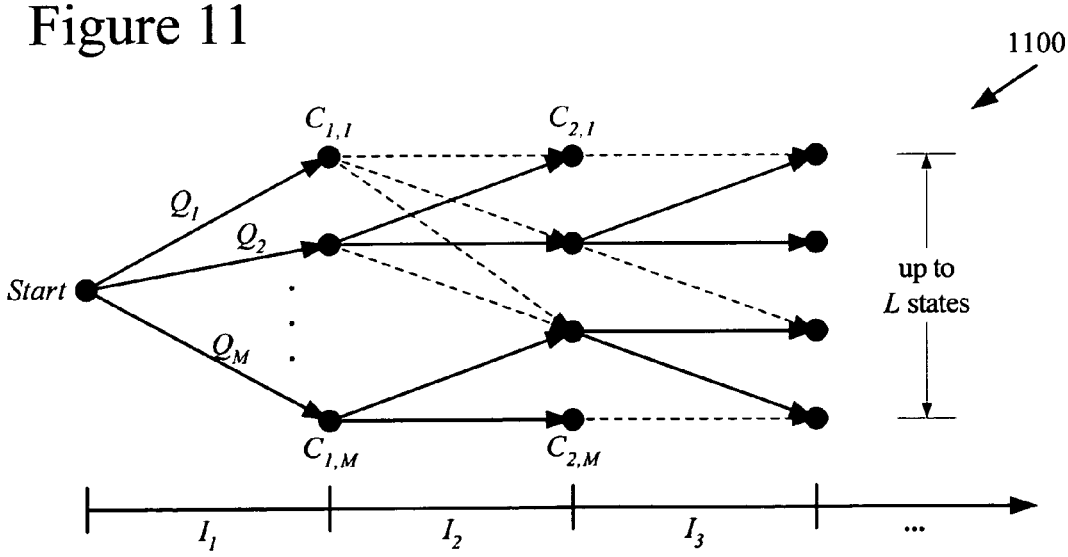
FIG. 11 is a diagram showing the evolution of possible traces of coded representations of audio input in a trellis-based approach.

Thus, in some embodiments, the encoder uses a trellis rather than a pure tree-structured approach. This is sometimes termed a Viterbi algorithm, which is an algorithm to compute the optimal (or most likely) stage sequence in a hidden Markov model, given a set of observed outputs. In a trellis-based approach, at each stage of compression, the encoder retains a maximum of L candidates, as shown in FIG. 11. At each stage, there are L states. From each state, going from one stage to the next, up to M transitions emanate from that state (e.g., each of the M transitions is for a different quantization step size). There may be multiple transitions from a previous stage leading into a single state of a given stage. Out of multiple incoming transitions into a single state, only one transition survives, as determined according to a cost function. The other transitions are pruned, as shown by the dashed lines in FIG. 11.

At the end of coding the input chunks, at most L candidate solutions will survive. Out of these, again according to the cost function, the encoder determines the best final solution. The encoder follows the path of encoding for the final solution to determine which decision (e.g., quantization step size) to make at each stage.

C. Trellis-based Encoding Techniques and Tools

When using a trellis-based approach to perform two-pass encoding and delayed-decision encoding, the encoder uses one or more different techniques and tools to improve the efficiency of the trellis-based encoding. For particular embodiments of trellis-based encoding, the encoder defines details in response to certain questions:

(1) What are the different states?

(2) What causes or dictates a state transition, while moving from one stage to the next?

(3) What is the cost function used to prune the transitions?

(4) How does pruning occur?

(5) What information is stored at each stage and each state (node)?

While the following sections describe a single combination having details addressing each of the above questions, different embodiments could have some of the same details while changing other details, for example, using buffer fullness levels as states (as in section 1) but using different cost functions.

1. States (Nodes) at Each Stage

The nodes in a trellis define positions in the trellis which are connected by transitions. The encoder treats nodes as states and defines the states through quantization of buffer fullness values. The encoder uses a virtual decoder buffer for this purpose. Instead, the encoder could use an encoder buffer, with some changes to the decision-making logic.

For the virtual decoder buffer, suppose the decoder buffer size (in bits) is $BF_{Max}$. Also suppose that the maximum number of states in each stage is L. The values of $BF_{Max}$ and L depend on implementation. In one implementation, the size of the buffer is expressed in seconds (having a size in bits equal to the "duration" of the buffer times the bitrate). The encoder tracks L=128 states if the maximum buffer fullness is 1.5 seconds or less. If the maximum buffer fullness is longer than 1.5 seconds, the encoder tracks L=256 states. Alternatively, the encoder uses different buffer sizes and/or a different number of states.

Figure 12:
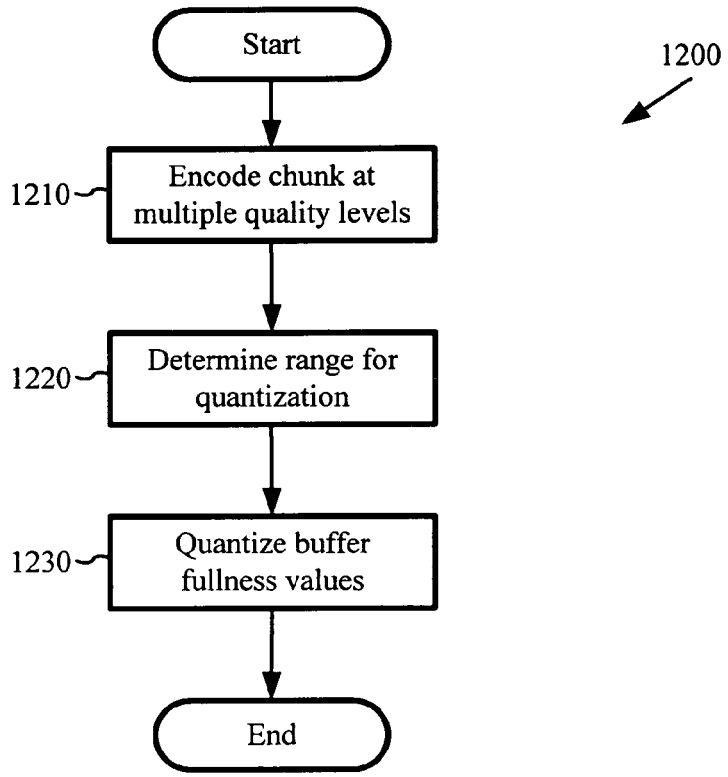
FIG. 12 is a flowchart showing a technique for adaptive, uniform quantization of buffer fullness levels.

The encoder quantizes actual decoder buffer fullness values to arrive one of the L states for each quantized value. In one implementation, the encoder uses adaptive, uniform quantization of buffer fullness levels for a chunk, as shown in FIG. 12.

The encoder encodes (1210) a chunk at multiple quality levels, for example, at different quantization step sizes. The encoder then determines (1220) a range for quantization at that stage. A simple rule to determine the state for a given buffer fullness value at stage n starts by defining a buffer quantization step size $BStep_n$ at that stage:

$$BStep_n = \frac{BF_{\text{Max}}}{L-1}. \tag{4}$$

The actual range of buffer fullness values is not necessarily 0 to $BF_{Max}$, particularly during the first few chunks in the sequence. Also, since any fullness beyond $BF_{Max}$ violates a CBR constraint, buffer fullnesses close to $BF_{Max}$ do not get used often. Consequently, the encoder adapts the range (and hence size) of the quantization step sizes for buffer fullness. This makes the step sizes smaller in appropriate circumstances. Specifically, at stage n, the buffer quantization step size $BStep_n$ is:

$$BStep_n = \frac{\max BF_{stage=n} - \min BF_{stage=n}}{L-1}, \quad (5)$$

where $\max BF_{stage=n}$ and $\min BF_{stage=n}$ are the actual buffer fullness maximum value and minimum value possible as of the end of stage n, respectively. The values of $\max BF_{stage=n}$ and $\min BF_{stage=n}$ depend on the range of buffer fullness states at the preceding stage n−1, as well as on the number of bits generated at the M quality levels at stage n for the current chunk. Rather than evaluate each possibility for $\max BF_{stage=n}$ and $\min BF_{stage=n}$ across all states from stage n−1 and all M possibilities for the current chunk, the encoder computes $\max BF_{stage=n}$ and $\min BF_{stage=n}$ as follows:

$$\max BF_{stage=n} = BF_{stage=n-1,state=highest} + R \cdot T_n - \mathrm{Bits}_{n,lowestQ}, \quad (6),$$

and $$\min BF_{stage=n} = BF_{stage=n-1,state=lowest} + R \cdot T_n - \mathrm{Bits}_{n,highestQ}, \quad (7),$$

where $BF_{stage=n-1,state=highest}$ is the highest buffer fullness state from the previous stage, $BF_{stage=n-1,state=lowest}$ is the buffer fullness state from the previous stage, R is the rate at which bits are added to the buffer, $T_n$ is the duration of the $n^{th}$ chunk, $\mathrm{Bits}_{n,lowestQ}$ is the number of bits spent encoding the $n^{th}$ chunk at the lowest quality, and $\mathrm{Bits}_{n,highestQ}$ is the number of bits spent encoding the $n^{th}$ chunk at the highest quality.

Using the buffer quantization step size $BStep_n$, the encoder quantizes (1230) each of the buffer fullness values for the current stage to one of the L possible states. Specifically, the encoder computes the quantized buffer fullness (i.e., state) for a particular fullness value BF at stage n according to:

$$quantizedBF_n = \left\lfloor \frac{BF_n + \frac{BStep_n}{2}}{BStep_n} \right\rfloor, \quad (8)$$

where the $$\frac{BStep_n}{2}$$

value and the ⌊ ⌋ operation control rounding of fractions to the nearest integer.

Alternatively, the encoder uses non-adaptive and/or non-uniform quantization of buffer fullness values. Or, the encoder defines states of the trellis based upon criteria other than or in addition to buffer fullness.

2. State Transitions

When the encoder encodes a new chunk of the input sequence, the encoder models transitions from the states of the previous stage to the states of the current stage. The transitions depend on the amounts of bits taken to encode the new chunk at different quality levels, as well as other factors such as the duration of the chunk. For each of the up to L states of the previous stage, the encoder computes up to M candidate transitions to the current stage. The encoder discards some of the candidate transitions for the states due to violation of CBR constraints by the transitions. The remaining transitions survive until the next phase of processing.

The number M of different quality levels tested depends on implementation. In one implementation, the encoder tests up to 11 quantization step sizes for each chunk. The encoder may check fewer quantization step sizes if any of the quantization step sizes to be tested are outside of an allowable range. The encoder discards the results for quantization step sizes that yield aberrant results (e.g., where a decrease in quantization step size results in a decrease in quality, rather than an expected increase in quality). The quantization step sizes tested may vary depending on the target bitrate, the results of previous encoding, or other factors. Or, the encoder may always test the same quantization step sizes.

The virtual decoder buffer is assumed to be full at the beginning of the sequence—$BF_{stage=0} = BF_{Max}$. At stage 1, suppose (a) encoding chunk 1 at a given quality level q produces $\mathrm{Bit}_{1,q}$ bits, (b) chunk 1 has a duration (in seconds) of $T_1$, and (c) the average bitrate is R bits/second. Then, the transition decoder buffer fullness $BF_{stage=1,quality=q}$ at stage 1 when using the quality level q for chunk 1 is:

$$BF_{stage=1,quality=q} = BF_{stage=0} + R \cdot T_1 - \mathrm{Bits}_{1,q} \quad (9).$$

The encoder tests the transition buffer fullness $BF_{stage=1,quality=q}$ against the applicable constraints (e.g., minimum quality, buffer underflow, buffer overflow, maximum bits per chunk, smoothness, legal bitstream, and/or legal packetization). If the transition buffer fullness fails any of these tests, the encoder prunes that transition from $BF_{stage=0}$. On the other hand, if the transition buffer fullness satisfies the constraints, the encoder quantizes the transition buffer fullness with the step size $BStep_1$ to determine the state that this transition takes at the end of stage 1.

More generally, the buffer evolution for the transition from stage n−1, state s to stage n for a chunk encoded at quality q is given by:

$$BF_{stage=n,state=s,quality=q} = BF_{stage=n-1,state=s} + R \cdot T_n - \mathrm{Bits}_{n,q}, \quad (10),$$

where $BF_{stage=n,state=s,quality=q}$ denotes the buffer fullness at stage n after transitioning from state s of the previous state (i.e., state n−1) with the $n^{th}$ chunk encoded at quality q. As described above, the encoder tests the transition buffer fullness $BF_{n,s,q}$ against CBR and other constraints. If the transition buffer fullness $BF_{n,s,q}$ fails any of these tests, the encoder prunes that transition from $BF_{stage=n,state=s}$, and that transition will not be considered again. On the other hand, if the transition buffer fullness $BF_{n,s,q}$ satisfies the constraints, the encoder quantizes the transition buffer fullness value with the step size $BStep_n$ to determine the state that this transition takes at the end of stage n:

$$quantizedBF_{n,s,q} = \left\lfloor \frac{BF_{n,s,q} + \frac{BStep_n}{2}}{BStep_n} \right\rfloor. \quad (11)$$

It is common for multiple transitions to be mapped to a single state at a given stage. In other words, multiple transitions from the various states of the previous stage end up with the same quantized buffer fullness. According to selection criteria such as those defined in a cost function, the encoder selects one of the multiple transitions that map to the single state, as described in the next section.

If the encoder uses an encoder buffer (rather than a virtual decoder buffer), the encoder assumes the encoder buffer to be empty at the beginning of the sequence—$BF_{stage=0}=0$. Instead of equation 10, the buffer evolution for the transition from stage n−1, state s to stage n for the $n^{th}$ chunk encoded at quality q is then given by:

$$BF_{n,s,q}=BF_{n-1,s}-R\cdot T_n+\text{Bits}_{n,q} \quad (12),$$

where, as above, $BF_{n,s,q}$ denotes the buffer fullness at stage n after transitioning from state s of the previous state (i.e., n−1) with the $n^{th}$ chunk encoded at quality q.

Alternatively, the encoder uses different and/or additional criteria to compute transitions.

3. Cost Function

After computing transitions from the previous stage to the current stage and pruning out unsuitable transitions, the encoder has a set of candidate transitions for the current stage. Within the set of candidate transitions, there may be conflicts when multiple transitions map to a single state. So, using a cost function, the encoder evaluates the candidate transitions competing with other transitions for a single state, analyzing the legal transitions that get mapped to a given single state in the current stage.

Figure 13:
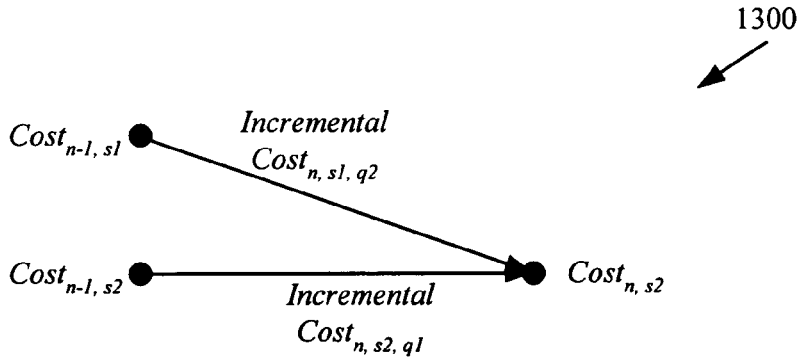
FIG. 13 is a diagram showing incremental costs for transitions in a trellis.

The cost function usually employed in trellis-based schemes is additive. The cost at the source node plus the cost of the transition gives the cost at the destination node. FIG. 13 shows incremental costs for two transitions leading into one node in a trellis. In particular, at a particular state s1 in previous stage n−1, the cost is $\text{Cost}_{n-1,s1}$. At another state s2 in the previous stage n−1, the cost is $\text{Cost}_{n-1,s2}$. Two transitions lead into the same state s2 in the current stage n. The first transition is from state s1 in the previous stage n−1 at quality q2, and that transition has an incremental cost $\text{IncrementalCost}_{n,s1,q2}$. The second transition is from state s2 in the previous stage n−1 at quality q1, and that transition has an incremental cost $\text{IncrementalCost}_{n,s2,q1}$. Mathematically, the encoder checks the costs for the respective traces leading into state s2 in the current stage n, taking the lower of:

$$\text{Cost}_{n,s2}=\text{Cost}_{n-1,s1}+\text{IncrementalCost}_{n,s1,q2} \quad (13),$$

and $$\text{Cost}_{n,s2}=\text{Cost}_{n-1,s2}+\text{IncrementalCost}_{n,s2,q1} \quad (14).$$

The incremental cost function depends on implementation. Many such functions relate to the quality of the encoded data for the transition. For example, the function uses the quantizer step size used, the PSNR obtained, mean squared error, Noise to Mask ratio ("NMR"), NER, or some other measure. Regardless of the quality metric used in the cost function, using an incremental cost function that focuses on the current chunk can lead to too many changes in quality. As a result, the overall quality of the sequence is not as smooth as it might be. To address the problems with a localized incremental cost function, the encoder defines a blended incremental cost for the transition from state s at quality q as follows:

$$\text{IncrementalCost}_{n,s,q}=|\text{CurrentQuality}-\text{HistoricAverageQuality}|+\lambda\cdot(\text{CurrentQuality}+\text{HistoricAverageQuality}) \quad (15),$$

where CurrentQuality is the quality metric value for the transition itself, and HistoricAverageQuality is an average of the quality metric values in a time window (e.g., the past few chunks) of the trace that ends in the transition. λ is a constant that governs the importance to be given to "smoothness" in the quality versus the quality itself (in absolute terms). Values of λ closer to 0 favor smoothness by deemphasizing the absolute value of the local quality; higher values of λ favor the local quality in absolute terms.

When used in a cost function, the blended incremental cost measure helps reduce the influence of local "spikes" in the overall determination of quality by giving weight to consistency in quality. To further reduce the effect of local spikes in quality, the encoder may discard extreme values in the trace window when computing the historic average quality.

The size of the trace window and value for λ depend on implementation. A trace window that is too small does not consider enough information for smoothness. A trace window that is too large is too slow. In one implementation, the encoder considers up to 21 past chunks (if those chunks are available) when computing historic average NER. In that time window, the encoder ignores the highest NER and the lowest NER values for the purpose of computing the average. In this implementation, λ=0.1. In other implementations, the size of the trace window, quality metric, and/or value for λ are different.

Alternatively, the encoder uses another cost function and/or considers different criteria in the cost function.

4. Pruning Transitions and States

As noted above, within the set of surviving transitions, there may be conflicts when multiple transitions map to a single state. After computing the costs associated with the candidate transitions surviving from the previous stage to the current stage, the encoder further prunes down the set of transitions until there is no more than one transition from the previous stage coming into each of the L states of the current stage. When multiple legal transitions get mapped to a single state, the transition with the best cost survives and all other transitions are discarded.

After such analysis, there are often nodes in the previous stage n−1 for which there is no surviving child node. If no child node survives for a node in a previous stage of the trellis, that node is not needed for the future processing. So, the encoder eliminates the node from the trellis.

Figure 14:
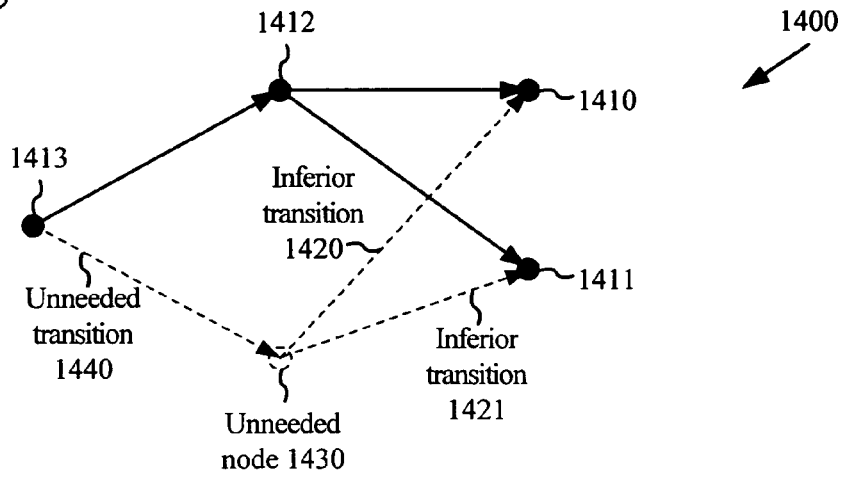
FIG. 14 is a diagram showing elimination of a node and transitions from a trellis.

FIG. 14 shows elimination of transitions (1420, 1421) and a node (1430) from a trellis. The eliminated node and transitions are shown in dashed lines in FIG. 14. After evaluation of the candidate transitions into the nodes (1410, 1411) of the current stage, the encoder eliminates the transitions (1420, 21) leading from the node (1430) as being less desirable than other transitions (traces) according to the cost function. Since the node (1430) no longer has any transitions out of it (and hence has no child nodes), the encoder also eliminates the node (1430).

Just as removal of transitions may trigger removal of nodes from the trellis, removal of nodes triggers removal of transitions into the nodes. When a node is eliminated, all transitions into that node can also be eliminated. In FIG. 14, for example, the encoder eliminates the transition (1440) leading into the eliminated node (1430). The encoder thus continually simplifies the trellis of older stages, while creating new nodes and transitions for newer stages from new input. By simplifying the older stages, the encoder dramatically reduces the complexity of maintaining the trellis.

5. Information Stored at Transitions and Nodes

The encoder stores information about the various transitions and nodes in the trellis. There are a number of possible variations on the information to be stored at each stage.

In one implementation, the encoder stores information defining the trellis structure, with information identifying surviving nodes and surviving transitions at each stage, the cost at each surviving node, and the actual buffer fullness at each node. Additionally, the encoder keeps some information (e.g., historical quality values) to compute the incremental costs.

Alternatively, the encoder stores other and/or additional information for the trellis.

D. Two-pass Encoding or Delayed-decision Encoding

Figure 15:
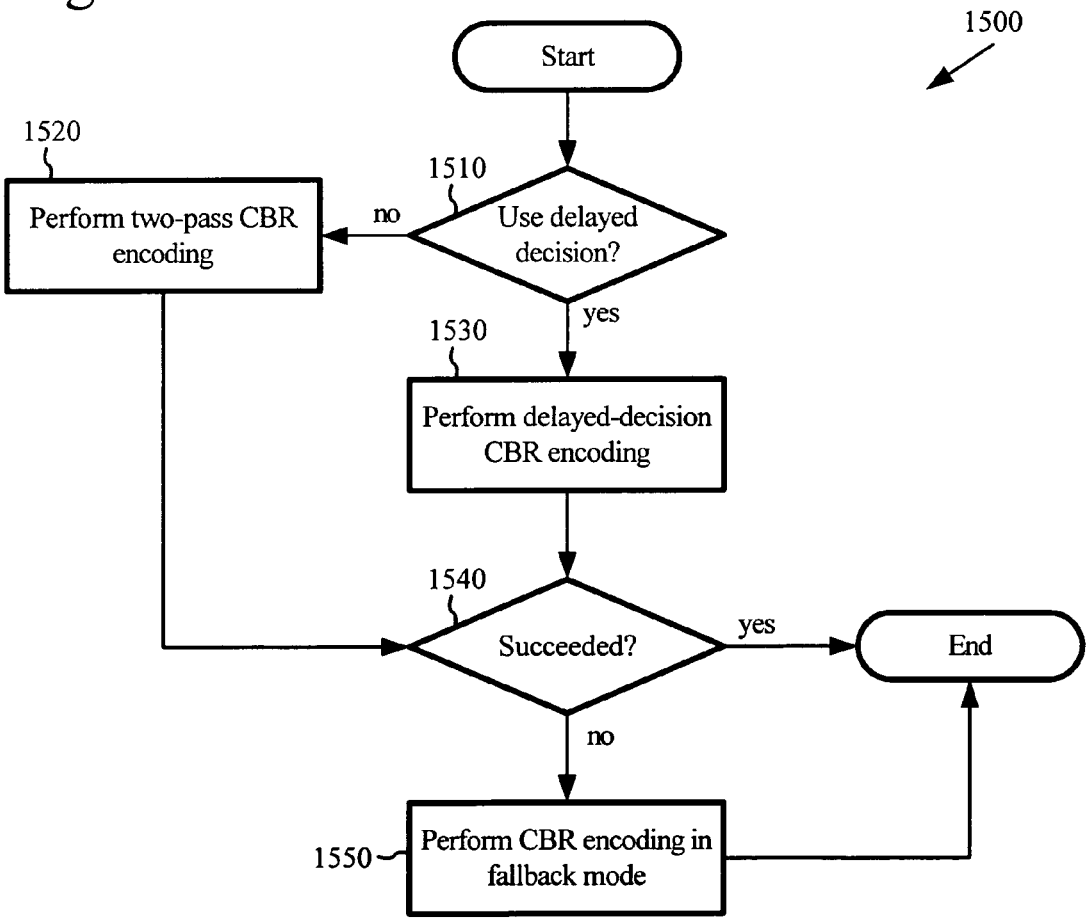
FIG. 15 is a flowchart showing a technique for switching between two-pass CBR encoding and delayed-decision CBR encoding.

The preceding description generally applies whether the encoder performs two-pass CBR encoding or delayed-decision CBR encoding. FIG. 15 shows a technique (1500) for switching between two-pas CBR encoding and delayed-decision CBR encoding.

Initially, an encoder determines (1510) whether to use delayed-decision CBR encoding or two-pass CBR encoding. For example, the encoder checks a user setting, or the encoder makes the determination based upon resources available for the encoding. The encoder then performs either two-pass CBR encoding (1520) or delayed-decision CBR encoding (1530).

In the two-pass CBR encoding (1520), the encoder proceeds as described above. At the end of the first pass, there may be several surviving traces. Of these, the encoder selects the trace with the best cost. The winning trace indicates which quality level to use for each input chunk. The encoder uses this information to compress the input during the second pass and produce the actual CBR output. If the encoder has cached auxiliary information from the first pass, the encoder uses the stored auxiliary information in the second pass to speed up the actual compression process in the second pass.

Figure 16:
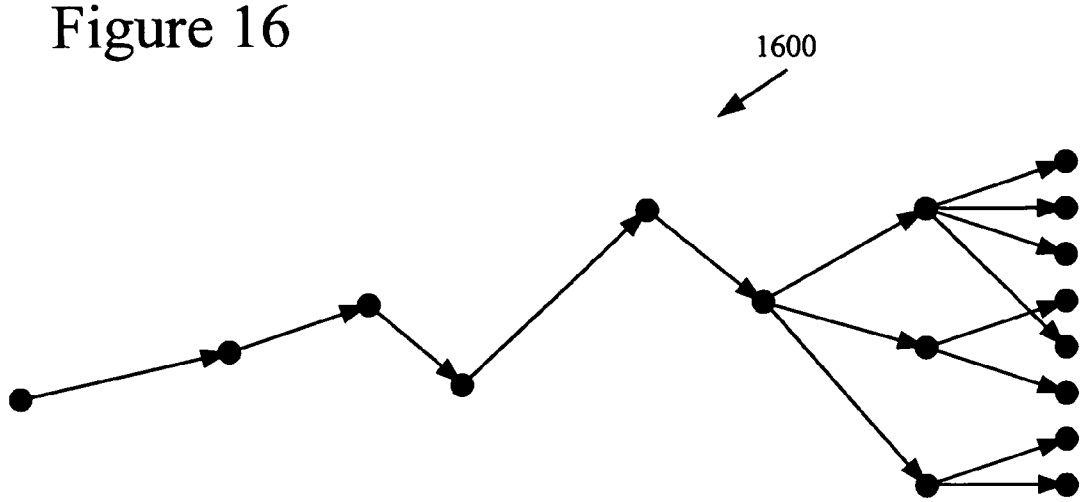
FIG. 16 is a diagram showing a trellis that has become simplified in older stages.

Alternatively, the encoder stores the actual compressed bits of encoded audio data at each of the surviving quality levels as of the end of the first pass. Older stages of a trellis frequently become simplified over time, as shown in the trellis (1600) of FIG. 16. This simplification results in only one transition and one node surviving at each of the stages before a certain point. In such cases, the encoder may output the compressed bits corresponding to those "sole surviving" transitions, after any necessary packetizing, etc. In effect, this results in one-pass encoding with an indeterminate (perhaps long) latency, and there is no need to feed the input to the encoder in the second pass.

In the delayed-decision CBR encoding (1530), the encoder forces a simplification of the trellis (to one surviving node per stage) if such a simplification does not happen within a required latency (i.e., delay). The encoder uses the cost function or other heuristics to force the simplification before the end of the input.

Figure 17:
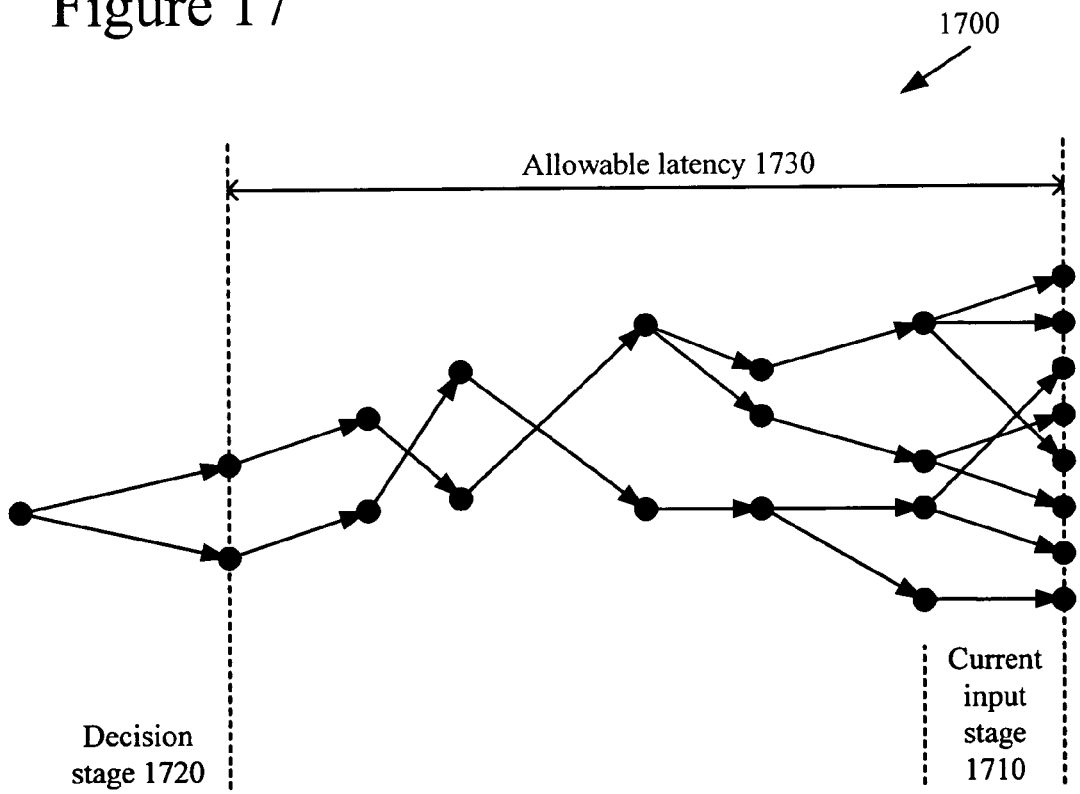
FIG. 17 is a diagram showing a trellis that will be forced to become simplified in delayed-decision encoding.

FIG. 17 shows a trellis (1700) that will be forced to become simplified in delayed-decision encoding. The encoder has finished encoding through the current input stage (1710) and considers the extant nodes just entering the decision stage (1720) of the delayed-decision encoding. The decision stage (1720) lags the current input stage (1710) by an allowable latency (1730) in the encoder. In the example shown in FIG. 17, the allowable latency (1730) is six chunks. Thus, the encoder makes an encoding decision on which quality should be used for the chunk six stages back. Alternatively, the allowable latency is some other fixed or varying duration.

The cost function or other heuristic is computed for each candidate node at the decision stage (1720). For example, the encoder considers:

(1) the average cost of all nodes at the current input stage (1710) that depend from the candidate node at the decision stage (1720);

(2) the least cost among all nodes at the current input stage (1710) that descend from the candidate node at the decision stage (1720); or (3) the number of nodes at the current input stage (1710) that descend from the candidate node at the decision stage (1720).

Alternatively, the encoder considers another cost function or heuristic.

Using such criteria, only one node at the decision stage (1720) survives. This directly provides the coding decision for the decision stage (1720). So, the encoder can output compressed bits for the chunk at the selected quality level at the decision stage (1720).

Delayed-decision CBR encoding limits the computational complexity of the control strategy by enforcing simplifications. In doing so, however, delayed-decision CBR encoding potentially eliminates traces that might eventually have proven to be better than the remaining traces. In this sense, two-pass CBR encoding considers a fuller range of options, by keeping nodes and transitions alive until they are eliminated as part of the normal pruning process.

After the completion of either the two-pass CBR encoding (1520) or the delayed-decision CBR encoding (1530), the encoder determines (1540) whether the CBR encoding succeeded. In some rare cases, there may be no valid traces surviving at the end of the sequence, for example, due to syntactic constraints on the output that are not considered in the trellis encoding. The encoder may mitigate this problem by (1) increasing the number of states at each stage, and/or (2) increasing the number of quality levels tested for each stage. The encoder may also determine (1540) whether CBR encoding has succeeded during (and before the end of) the two-pass CBR encoding (1520) or the delayed-decision CBR encoding (1530), In this configuration (not shown in FIG. 15), the encoder continues the two-pass CBR encoding (1520) or the delayed-decision CBR encoding (1530) if the encoding has succeeded up to that point.

When a problem occurs, however, the encoder performs CBR encoding in a fallback mode (1550). Generally, the encoder has three choices: (1) the encoder discards already compressed (and potentially emitted) bits and performs one-pass CBR encoding from the very beginning of the sequence; (2) the encoder consider the bits already emitted by the encoder as committed, but performs one-pass CBR encoding for the remainder of the sequence; or 3) the encoder uses one-pass CBR encoding for a pre-defined or varying time, then switches back to the earlier trellis-based solution in the two-pass CBR encoding (1520) or the delayed-decision CBR encoding (1530). In the one-pass CBR encoding in the fallback mode (1550), the encoder prevents buffer underflow/overflow and satisfies other CBR constraints using a CBR rate control strategy, for example, one of the rate control strategies described in U.S. patent application Ser. No. 10/017,694, filed Dec. 14, 2001, entitled "Quality and Rate Control Strategy for Digital Audio," published on Jun. 19, 2003, as Publication No. US-2003-0115050-A1, hereby incorporated by reference. Alternatively, the encoder uses another technique to avoid buffer underflow/overflow and satisfy any other constraints that apply.

In a live encoding session, the encoder is likely using delayed-decision CBR encoding (1530). Fallback choice (1) may not be an option, as some bits will likely have already been committed. So, the encoder uses choice (2) or (3).

Syntactic constraints are the main reason that one-pass CBR encoding succeeds when the two-pass CBR encoding or the delayed-decision CBR encoding fails. The one-pass CBR encoder can go back by x chunks and code those x chunks at reduced or improved quality, if it must, to satisfy CBR constraints. The two-pass and delayed-decision mechanisms lack that mechanism. Alternatively, however, the encoder has a fourth fallback option—the two-pass or delayed-decision CBR encoder uses such a mechanism. For example, the encoder is allowed to go back by an arbitrary number of chunks and revise the trellis by coding the chunks at new quality levels. In this case, the two-pass or delayed-decision CBR encoder would produce output according to a valid trace.

Having described and illustrated the principles of our invention with reference to various embodiments, it will be recognized that the described embodiments can be modified in arrangement and detail without departing from such principles. It should be understood that the programs, processes, or methods described herein are not related or limited to any particular type of computing environment, unless indicated otherwise. Various types of general purpose or specialized computing environments may be used with or perform operations in accordance with the teachings described herein. Elements of the described embodiments shown in software may be implemented in hardware and vice versa.

In view of the many possible embodiments to which the principles of our invention may be applied, we claim as our invention all such embodiments as may come within the scope and spirit of the following claims and equivalents thereto.

We claim:

1. In an audio encoder, a computer-implemented method of audio encoding according to a control strategy, the method comprising:

receiving a sequence of audio data;

encoding the sequence of audio data using a trellis to produce a bitstream of encoded audio data at constant or relatively constant bitrate, wherein the trellis include plural transitions, and wherein each of the plural transitions corresponds to an encoding of a chunk of plural samples of the audio data at a quality level, and wherein the encoding includes pruning the trellis according to a cost function that considers smoothness of quality changes; and outputting the bitstream of encoded audio data.

2. The method of claim 1 wherein the cost function also considers noise to excitation ratio.

3. The method of claim 1 wherein the cost function considers both quality and the smoothness of quality changes.

4. The method of claim 1 further comprising:

storing encoded data for each of plural chunks encoded at each of plural quality levels;

determining a trace through the sequence, wherein the trace includes a determination of a selected quality level for each of the plural chunks; and stitching together parts of the stored encoded data for the sequence along the trace to produce the bitstream.

5. The method of claim 1 wherein the encoding is two-pass encoding.

6. The method of claim 1 wherein the encoding is delayed-decision encoding.

7. The method of claim 6 wherein the encoding includes simplifying the trellis according to one or more criteria, if necessary, as the trellis exits a latency window, wherein the one or more criteria are based upon a candidate node exiting the latency window and one or more current nodes that descend from the candidate node.

8. The method of claim 1 wherein the trellis includes plural nodes based upon quantization of buffer fullness levels.

9. The method of claim 8 wherein the buffer fullness levels are for a virtual decoder buffer.

10. The method of claim 8 wherein the buffer fullness levels are for an encoder buffer.

11. The method of claim 8 wherein the quantization is adaptive depending on range of the buffer fullness levels.

12. The method of claim 1 wherein the outputting is to a persistent storage medium.

13. The method of claim 1 wherein the outputting is to a network connection.

14. The method of claim 1 wherein the outputting begins before the encoding ends.

15. A storage medium storing computer-executable instructions for causing a computer system programmed thereby to perform the method of claim 1.

16. In a media encoder, a computer-implemented method of media encoding according to a control strategy, the method comprising:

receiving a sequence of media data;

in a first pass, encoding the sequence of media data using a trellis to determine a trace through the sequence of media data, wherein the media data includes plural portions, and wherein the trace includes a determination of a quality level for each of the plural portions of the media data;

in a second pass, encoding the sequence of media data along the trace to produce bitstream of encoded media data at constant or relatively constant bitrate; and outputting the bitstream of encoded media data.

17. A storage medium storing computer-executable instructions for causing a computer system programmed thereby to perform the method of claim 16.

18. The method of claim 16 wherein each of the portions is a chunk of plural samples.

19. The method of claim 16 wherein the media data are audio data.

20. In a media encoder, a computer-implemented method of media encoding according to a control strategy, the method comprising:

receiving a sequence of media data;

encoding the sequence of media data using a trellis to produce a bitstream of encoded media data at constant or relatively constant bitrate, wherein the encoding includes pruning the trellis according to a cost function that considers smoothness in quality changes as well as quality according to noise to excitation ratio; and outputting the bitstream of encoded media data.

21. A storage medium storing computer-executable instructions for causing a computer system programmed thereby to perform the method of claim 20.

22. The method of claim 20 wherein the media data are audio data.

23. In a media encoder, a computer-implemented method of media encoding according to a control strategy, the method comprising:

receiving the sequence of media data;

encoding a sequence of media data using a trellis to produce a bitstream of encoded media data at constant or relatively constant bitrate, wherein the encoding includes pruning the trellis according to a cost function that considers both quality and smoothness in quality changes; and outputting the bitstream of encoded media data.

24. A storage medium storing computer-executable instructions for causing a computer system programmed thereby to perform the method of claim 23.

25. The method of claim 23 wherein the media data are audio data.

26. In a media encoder, a computer-implemented method of media encoding according to a control strategy, the method comprising:

receiving a sequence of media data;

encoding the sequence of media data, including encoding each of plural portions of the sequence at each of multiple different quality levels, wherein the encoding uses a trellis with plural nodes based upon quantization of buffer fullness levels, and wherein the quantization of the buffer fullness levels is adaptive during the encoding;

storing encoded data for the plural portions encoded at each of the multiple different quality levels;

determining a trace through the sequence of media data, wherein the trace includes a determination of a selected quality level for each of the plural portions;

stitching together parts of the stored encoded data for the sequence along the trace to produce a bitstream of encoded media data at constant or relatively constant bitrate; and outputting the bitstream of encoded media data.

27. A storage medium storing computer-executable instructions for causing a computer system programmed thereby to perform the method of claim 26.

28. The method of claim 26 wherein the media data are audio data.

29. The method of claim 26 wherein the plural portions are for the entire sequence.

30. In a media encoder, a computer-implemented method of media encoding according to a control strategy, the method comprising:

receiving a sequence of media data;

selecting between a two-pass encoding mode and a delayed-decision encoding mode;

if the two-pass encoding mode is selected, in a first pass, encoding the sequence of media data to determine coding decisions for the sequence of media data; and in a second pass, encoding the sequence of media data using the coding decisions to produce a bitstream of encoded media data at constant or relatively constant bitrate;

if the delayed-decision encoding mode is selected, encoding the sequence of media data to produce the bitstream of encoded media data, including enforcing simplification of a trace through the sequence of media data, if necessary, outside of a window of allowable latency; and outputting the bitstream of encoded media data.

31. A storage medium storing computer-executable instructions for causing a computer system programmed thereby to perform the method of claim 30.

32. The method of claim 30 wherein the media data are audio data.

33. The method of claim 30 wherein the encoding in the first pass uses a trellis, and wherein the coding decisions indicate transitions in the trellis.

34. The method of claim 30 wherein the encoding in the delayed-decision encoding mode uses a trellis.

35. In a media encoder, a computer-implemented method of media encoding according to a delayed-decision control strategy, the method comprising:

receiving a sequence of media data;

encoding the sequence of media data using a trellis to produce a bitstream of encoded media data at constant or relatively constant bitrate, wherein the encoding includes simplifying the trellis according to one or more criteria, if necessary, as the trellis exits a latency window, wherein the one or more criteria are based upon a candidate node exiting the latency window and one or more current nodes that descend from the candidate node; and outputting the bitstream of encoded media data.

36. A storage medium storing computer-executable instructions for causing a computer system programmed thereby to perform the method of claim 35.

37. The method of claim 35 wherein the media data are audio data.

38. The method of claim 35 wherein the one or more criteria include average cost of the one or more current nodes.

39. The method of claim 35 wherein the one or more criteria include least cost of the one or more current nodes.

40. The method of claim 35 wherein the one or more criteria include count of the one or more current nodes.

41. In a media encoder, a computer-implemented method of media encoding according to a control strategy, the method comprising:

receiving a sequence of media data;

encoding the sequence of media data using a trellis to produce a bitstream of encoded media data at constant or relatively constant bitrate, wherein the trellis includes plural nodes based upon quantization of buffer fullness levels, and wherein the quantization of the buffer fullness levels is adaptive during the encoding; and outputting the bitstream of encoded media data.

42. A storage medium storing computer-executable instructions for causing a computer system programmed thereby to perform the method of claim 41.

43. The method of claim 41 wherein the media data are audio data.

44. The method of claim 41 wherein the buffer fullness levels are for a virtual decoder buffer.

45. The method of claim 41 wherein the buffer fullness levels are for an encoder buffer.

46. The method of claim 41 wherein the quantization changes depending on range of the buffer fullness levels.

47. In a media encoder, a computer-implemented method of media encoding according to a control strategy, the method comprising:

receiving a sequence of media data;

performing either two-pass or delayed-decision encoding of the sequence of media data;

checking whether the encoding has succeeded and, if the encoding has not succeeded, performing one-pass encoding of at least part of the sequence; and outputting a bitstream of encoded media data at constant or relatively constant bitrate.

48. A storage medium storing computer-executable instructions for causing a computer system programmed thereby to perform the method of claim 47.

* * * * *

UNITED STATES PATENT AND TRADEMARK OFFICE

CERTIFICATE OF CORRECTION

PATENT NO. : 7,383,180 B2
APPLICATION NO. : 10/622822
DATED : June 3, 2008
INVENTOR(S) : Naveen Thumpudi et al.

It is certified that error appears in the above-identified patent and that said Letters Patent is hereby corrected as shown below:

In column 31, line 48, in Claim 1, after “transitions,” delete “and”.

In column 32, line 41, in Claim 16, after “produce” insert -- a --.

In column 33, line 4, in Claim 23, after “receiving” delete “the” and insert -- a --, therefor.

In column 33, line 5, in Claim 23, after “encoding” delete “a” and insert -- the --, therefor.

Signed and Sealed this
Nineteenth Day of April, 2011

David J. Kappos

David J. Kappos
*Director of the United States Patent and Trademark Office*